US007012211B2

(12) United States Patent
Brinkley et al.

(10) Patent No.: US 7,012,211 B2
(45) Date of Patent: Mar. 14, 2006

(54) SINGLE PASS SEQUENCING ASSEMBLY

(75) Inventors: Dick D. Brinkley, Lowell, MI (US); Arthur J. Terpstra, Jr., Allendale, MI (US); Ricardo N. Schiesser, Rockford, MI (US); Jack W. Tomanek, Grand Rapids, MI (US)

(73) Assignee: Rapistan Systems Advertising Corp., Grand Rapids, MI (US)

( * ) Notice: Subject to any disclaimer, the term of this patent is extended or adjusted under 35 U.S.C. 154(b) by 271 days.

(21) Appl. No.: 10/430,525

(22) Filed: May 6, 2003

(65) Prior Publication Data

US 2003/0209473 A1 Nov. 13, 2003

Related U.S. Application Data

(60) Provisional application No. 60/378,251, filed on May 7, 2002, provisional application No. 60/411,909, filed on Sep. 19, 2002.

(51) Int. Cl.
*B07C 5/36* (2006.01)

(52) U.S. Cl. ..... 209/584; 209/900; 209/583; 700/214; 700/215; 700/225; 700/226; 270/52.01; 270/52.02; 270/52.03

(58) Field of Classification Search ..... 209/584, 209/900; 700/115, 214–300; 270/52.01, 270/52.02, 52.03
See application file for complete search history.

(56) References Cited

U.S. PATENT DOCUMENTS

| | | | | |
|---|---|---|---|---|
| 3,184,061 A | 5/1965 | Levy | 209/584 |
| 3,613,911 A | 10/1971 | Walchhuter | 214/16.4 R |
| 3,757,939 A | 9/1973 | Henig | 209/72 |
| 3,884,408 A | 5/1975 | Leiter et al. | 227/100 |
| 3,905,491 A | 9/1975 | Harrison | 214/11 R |
| 3,945,505 A | 3/1976 | Frisbie et al. | 214/1 BB |
| 3,988,017 A | 10/1976 | Kyhl | 271/111 |
| 4,058,217 A | 11/1977 | Vaughan et al. | 209/74 M |
| 4,228,995 A | 10/1980 | Breuers et al. | 271/292 |
| 4,244,672 A | 1/1981 | Lund | 414/134 |
| 4,310,276 A | 1/1982 | Castagnoli | 414/134 |
| 4,468,165 A | 8/1984 | Kawasaki | 414/417 |
| 4,507,739 A | 3/1985 | Haruki et al. | 364/478 |
| 4,554,873 A | 11/1985 | Rex | 104/88 |
| 4,567,988 A | 2/1986 | Weibel | 209/564 |

(Continued)

FOREIGN PATENT DOCUMENTS

| | | |
|---|---|---|
| DE | 19647973 | 11/1996 |

(Continued)

*Primary Examiner*—Donald P. Walsh
*Assistant Examiner*—Jonathan R. Miller
(74) *Attorney, Agent, or Firm*—Van Dyke, Gardner, Linn & Burkhart, LLP

(57) ABSTRACT

A method and apparatus for sequencing articles via a single sort pass or process includes a plurality of article receivers or collators positioned along a conveying or transport path and a plurality of carriages movable along the path. The carriages receive articles from at least one induct in a generally random manner and discharge the articles at the appropriate collators. The collators are operable to selectively receive the articles at an appropriate one of a plurality of bins of the collators, such that the articles are positioned within the bins of the collators in a sequenced manner. The articles may be unloaded to a plurality of collecting devices and/or manually unloaded and placed or stacked in a container in the desired sequence. The collecting devices may be manually unloaded while the collators simultaneously selectively receive articles during a subsequent sort wave or process.

55 Claims, 18 Drawing Sheets

U.S. PATENT DOCUMENTS

| | | | | |
|---|---|---|---|---|
| 4,641,753 | A | 2/1987 | Tamada | 209/546 |
| 4,790,119 | A | 12/1988 | McDaniels | 53/411 |
| 4,907,699 | A | 3/1990 | Butcher et al. | 209/3.3 |
| 4,991,719 | A | 2/1991 | Butcher et al. | 209/3.3 |
| 5,009,321 | A | 4/1991 | Keough | 209/3.1 |
| 5,038,911 | A | 8/1991 | Doane et al. | 198/357 |
| 5,042,667 | A | 8/1991 | Keough | 209/3.1 |
| 5,119,954 | A | 6/1992 | Svyatsky et al. | 209/584 |
| 5,263,300 | A | 11/1993 | Plent et al. | 53/244 |
| 5,337,880 | A | 8/1994 | Claycomb et al. | 198/347.3 |
| 5,353,938 | A | 10/1994 | La Grange et al. | 209/584 |
| 5,385,243 | A | 1/1995 | Jackson et al. | 209/509 |
| 5,395,206 | A | 3/1995 | Cerny, Jr. | 414/786 |
| 5,411,151 | A | 5/1995 | Sasada | 209/583 |
| 5,588,520 | A | 12/1996 | Affaticati et al. | 198/370.06 |
| 5,667,078 | A | 9/1997 | Walach | 209/584 |
| 5,718,321 | A | 2/1998 | Brugger et al. | 198/359 |
| 5,803,704 | A | 9/1998 | Lazzarotti | 414/793.4 |
| 5,833,076 | A | 11/1998 | Harres et al. | 211/51 |
| 5,857,830 | A | 1/1999 | Harres et al. | 414/798.9 |
| 5,860,504 | A | 1/1999 | Lazzarotti | 198/357 |
| 5,893,464 | A | 4/1999 | Kiani et al. | 209/584 |
| 5,924,576 | A | 7/1999 | Steenge | 209/584 |
| 5,959,868 | A | 9/1999 | Oppliger et al. | 364/478.14 |
| 5,977,501 | A | 11/1999 | Werkheiser et al. | 209/583 |
| 6,024,425 | A | 2/2000 | Imai et al. | 312/35 |
| 6,026,967 | A | 2/2000 | Isaacs et al. | 209/539 |
| 6,169,936 | B1 | 1/2001 | Lohmann | 700/224 |
| 6,241,099 | B1 | 6/2001 | Hendrickson et al. | 209/542 |
| 6,276,509 | B1 | 8/2001 | Schuster et al. | 198/370.02 |
| 6,328,302 | B1 | 12/2001 | Hendrickson et al. | 271/207 |
| 6,478,138 | B1 | 11/2002 | Edwards et al. | 198/370.06 |
| 6,499,582 | B1 | 12/2002 | Gillott | 198/360 |
| 6,501,041 | B1 | 12/2002 | Burns et al. | 209/584 |
| 6,513,641 | B1 | 2/2003 | Affaticati et al. | 198/357 |
| 6,555,776 | B1 * | 4/2003 | Roth et al. | 209/584 |
| 6,561,339 | B1 | 5/2003 | Olson et al. | 198/349 |
| 6,561,360 | B1 | 5/2003 | Kalm et al. | 209/606 |
| 6,685,030 | B1 | 2/2004 | Mileaf | 209/542 |
| 6,881,916 | B1 | 4/2005 | McLaughlin et al. | 209/584 |
| 2002/0125177 | A1 | 9/2002 | Burns et al. | |
| 2003/0209474 | A1 | 11/2003 | Nakanishi et al. | |

FOREIGN PATENT DOCUMENTS

| | | | |
|---|---|---|---|
| EP | 0399510 | | 11/1990 |
| EP | 495661 | A2 | 7/1992 |
| EP | 0761322 | A1 | 3/1997 |
| EP | 774303 | A2 | 5/1997 |
| NL | 8403680 | | 7/1986 |
| WO | WO9710904 | | 3/1997 |
| WO | WO0105523 | A1 | 1/2001 |

* cited by examiner

SINGLE PASS SEQUENCING ASSEMBLY

CROSS REFERENCE TO RELATED APPLICATIONS

The present application claims the benefit of U.S. provisional applications, Ser. No. 60/378,251, filed May 7, 2002 by Terpstra et al. for SINGLE PASS SEQUENCING ASSEMBLY; and Ser. No. 60/411,909, filed Sep. 19, 2002 by Terpstra et al. for SINGLE PASS SEQUENCING ASSEMBLY, which are hereby incorporated herein by reference in their entireties.

FIELD OF THE INVENTION

The present invention relates generally to an article sorting method and apparatus and, more particularly, to an article sorting method and apparatus for the sortation of articles to a delivery point sequence or stocking sequence, such as the sortation of cards to a desired sequence for stocking racks or shelves of cards.

BACKGROUND OF THE INVENTION

Typically, cards, such as greeting cards and/or the like, are supplied to stores in packets or packages, where each package contains several of the same card, such as five cards and envelopes. In order to facilitate stocking of the shelves or racks of cards at the retail store or the like, it is desirable to have the packages of cards shipped in a desired order or sequence, so that the person placing the cards on the racks may do so in an orderly and sequenced manner. Different stores typically have different orders or sequences of the cards on their respective racks or shelves. Therefore, the cards are sorted to the desired order for the different stores prior to shipment to the store. This may result in different sort processes for the different stores that the cards are shipped to.

Typically, the packages of cards are sequenced or placed in the desired order via a double sort or double pass process. This process requires that the cards be sorted twice, such as two passes through a single sorter mechanism or process, or two passes through different sorter mechanisms or processes. Such double sort processes require additional manual intervention and, thus, may decrease the efficiency and add to the cost of the sortation or sequencing process.

SUMMARY OF THE INVENTION

The present invention provides a method and apparatus for sorting articles, such as packets or packages of cards or the like, to a desired sequence or order, such that the cards may be easily put on a shelf or rack in a store in the desired order. The method and apparatus of the present invention may sort the articles to the desired order or sequence or delivery point sequence via a single sort pass.

According to an aspect of the present invention, a single pass sorting or sequencing assembly or system is provided for automatically sorting and sequencing packages or items to an unloading station in a sequenced manner. The single pass sequencing assembly includes a transport mechanism for transporting articles and at least one article receiver. The article receiver is operable to selectively receive articles from the transport mechanism, such that the articles are received and sequenced in the article receiver at a delivery point sequence after a single sort pass.

The at least one article receiver may comprise a plurality of bins. The bins are selectively movable to align an appropriate one of the bins with a discharge of the transport mechanism to selectively receive an article in the appropriate one of the bins from the transport mechanism. The single pass sequencing may include at least one collecting device for collecting sequenced articles from the at least one article receiver. The collecting device comprises a plurality of collector bins which are positionable relative to the bins of the article receiver for receiving articles from the bins of the article receiver. Each of the plurality of collector bins is adapted to receive articles from at least two of the plurality of bins of the article receiver.

In one form, the article receiver is positioned generally horizontal and the collecting device is positioned generally horizontal and generally beneath the article receiver. The collecting device may be generally horizontally movable to an unloading position away from the article receiver for unloading of articles within the collecting device. The article receiver may be operable to selectively receive articles while the collecting device is in the unloading position.

In another form, the article receiver is positioned generally vertically. The article receiver may pivot toward a horizontal position or the collecting device may pivot toward a horizontal unloading position.

The at least one article receiver may comprise a plurality of article receivers positioned along a conveying path. The transport mechanism transports articles along the conveying path to an appropriate one of the plurality of article receivers.

According to another aspect of the present invention, a method of sorting articles to a particular sequence includes transporting articles with a transport mechanism and inducting articles to at least one article receiver. The method further includes selectively receiving the articles in a plurality of bins of the article receiver such that the articles are received and sequenced in the article receiver in a delivery point sequence after a single sort pass.

The method may include loading articles onto a carriage of the transport mechanism and discharging articles from the carriage to the article receiver or collating device. The articles are selectively received in bins of the article receiver in a sequenced order. The articles are then removed or discharged from the bins of the article receiver in the desired sequence. The bins of the article receiver may be movable relative to a discharge chute of the transport assembly so as to selectively receive the articles in the appropriate bins.

The articles may be discharged from the bins of the article receiver into corresponding bins of a buffer or collecting device and then unloaded from the bins of the collecting device in the desired sequence. The articles are discharged from the bins of the article receiver after the article receiver has received articles from a first sort wave or process and the bins of the article receiver are generally filled or at least partially filled.

According to another aspect of the present invention, a sequencing assembly comprises a transport assembly for transporting articles along a transport path and a plurality of collating devices positioned along the transport path. The transport assembly is operable to receive articles from an induct and to discharge articles to an appropriate one of the collating devices. Each of the collating devices includes a plurality of bins for receiving articles discharged from the transport assembly. The collating devices are operable to selectively receive articles discharged from the transport assembly in appropriate bins so that articles are received in the bins of the collating devices in a sequenced manner.

The collating devices may be operable to selectively move the bins of the collating device to align with a discharge chute to receive articles as they are discharged from the carriages. The appropriate bin may be moved to align with a discharge chute when an article corresponding to the appropriate bin arrives at the collating device and is discharged by the transport assembly.

In one form, the transport assembly includes a plurality of carriages movable along the transport path and operable to discharge articles onto an appropriate discharge conveyor at the appropriate one of the collating devices. The carriages may be crossbelt sorters having a continuous carrier belt which is movable toward either side of the sorter carriage to receive articles from an induct and to discharge articles to discharge conveyors and collating devices at either side of the conveying path. Optionally, the carriages may be double width crossbelt sorters, which include a pair of side-by-side carrier belts, each of which is movable toward either side to receive articles and to discharge articles to one side of the conveying path or to transfer articles to the other of the pair of side-by-side carrier belts.

Optionally, the discharge conveyor may be operable to accumulate or buffer articles after they are discharged or unloaded from the carriages and before they are discharged to the bins of the collating device. The discharge conveyor may include one or more conveyor belts which are operable to receive the articles from the carriages and may pause or delay conveying the articles to the collating device. Alternately, or in addition thereto, the discharge conveyor may include a door or stop at the discharge chute which temporarily stops the articles from being delivered to or received by the bins of the collating device. This delays the delivery of the articles to the collating device to allow time for the collating device to move and align the appropriate bin with the discharge chute of the discharge conveyor. The discharge conveyor may be tilted toward one side to align articles along one side of the conveyor belt.

Optionally, the sequencing assembly may include a plurality of collecting devices or collectors which receive and collect the sequenced articles from the bins of the collating devices after the articles have been sequenced and received by the collating devices. The collecting device provides a plurality of collector bins for receiving the sequenced articles. The plurality of bins of the collecting devices may be adapted to hold articles from at least two of the bins of the respective collating devices, to ease removal of the articles from the collecting devices by an operator. The bins of the collating device may be movable to align with the bins of the respective collecting device and may be opened to discharge, drop or dump the articles from the collating device into the collecting device in the desired sequence. In one form, all of the doors or bottoms of the bins of a particular collating device may be opened generally simultaneously to discharge the sequenced articles from the bins. The collecting device may then be unloaded by an operator while the collating device selectively receives articles from a new or subsequent sort wave or process.

Each of the collecting devices may be movable between a loading position where a collecting device is generally aligned with a respective collating device and an unloading position where the collector bins are accessible to an operator for unloading of the collecting device. Optionally, the collating devices may be operable to receive articles from the sorter carriages during a second sort wave while the collecting devices are being simultaneously unloaded by at least one operator.

In one form, the collating devices are generally vertical and tilted at an angle with respect to vertical such that the articles are received by the collating devices in a manner whereby gravity functions to move the articles toward a side or corner of the respective bins of the collating devices. The discharge conveyor between the carriages and the collating device may also be angled to align with the bins of the collating device. The collecting device may also be tilted so as to generally correspond to the tilt of the collating device, such that when the bins of the collating device are opened, the articles fall or drop into the collector in the sorted order or sequence. The collecting device may be adjustable or tiltable to a generally horizontal position after it has received the articles from the collating device to ease the removal of the sequenced articles from the collecting device by the operator.

In another form, the collating devices are positioned generally horizontally, such that articles are received from a discharge chute positioned generally above each of the collating devices. A discharge assembly may be operable to align and guide the articles along one side (such as along a side of a conveyor which conveys the articles to the discharge chute) such that the articles are generally aligned at one side of the collating device after they have been discharged to the bins of the collating device. Optionally, the collating device may be oriented such that the articles are dropped or discharged to a side or corner of the bins of the collating device to ease alignment of the articles. The collating device is generally horizontally movable relative to the bins of a generally horizontal collecting device to align the bins of the collating device with the bins of the collecting device, such that the articles are dropped or discharged generally vertically into the bins of the collecting device when the bins of the collating device are opened. The collecting device may be movable between a loading position generally beneath the collating device and an unloading position remote from the collating device, whereby an operator may unload the articles from the collecting device while the collating device continues to receive articles from the discharge conveyor or chute.

According to another aspect of the present invention, a sequencing assembly or single pass article sequencing system includes a transport assembly, which includes a conveying path and a plurality of carriages movable along the conveying path, a plurality of collators positioned along the conveying path, and a plurality of collecting devices. Each of the plurality of carriages is operable to receive articles from an induct and to discharge articles to an appropriate one of the collators. Each of the collators includes a plurality of bins for receiving articles discharged from the carriages. The collators are operable to selectively move the bins to receive articles discharged from the carriages in appropriate bins so that articles are received in the bins of the collators in a sequenced manner. The collecting devices are configured to receive the sequenced articles from the collators. The collators are operable to discharge the received and sequenced articles in the bins into a respective collecting device. The collecting devices are then movable to an unloading position for unloading the sequenced articles therefrom.

According to yet another aspect of the present invention, a method of sorting articles to a desired sequence includes providing a transport assembly having a conveying path, at least one induct along the conveying path, and a plurality of carriages movable along the conveying path. Articles are loaded onto the carriages and discharged from the carriages to a discharge chute at a particular one of a plurality of collators positioned along the conveying path. Each of the collators includes a plurality of collator bins. The bins are selectively moved to align an appropriate bin with the discharge chute. The discharged articles are selectively received at an appropriate one of the collator bins such that the articles are arranged or stacked in the collator bins in a sequenced manner. The sequenced articles in the collator bins are discharged to respective ones of a plurality of collecting devices and the sequenced articles are received in the plurality of collecting devices.

Optionally, the collator bins may be unloaded by aligning the collator bins with corresponding collector bins of the collecting devices and unloading the collator bins to respective ones of the collector bins. The collecting devices may be moved to an unloading position after receiving the sequenced articles. The collector bins may then be manually unloaded while the collator bins simultaneously selectively receive the discharged articles during a second sort wave or process.

Optionally, the method may include buffering the articles after they are unloaded or discharged from the carriages and before they are received by the collator bins. The buffering may be performed while the collator bins are being moved to align the appropriate one of the collator bins with the discharge chute.

According to another aspect of the present invention, a single sort pass article sequencing system includes a sorter assembly and at least one collator. The sorter assembly includes a conveying path and a plurality of sorter carriages movable along the conveying path. The sorter assembly includes at least one induct operable to induct articles onto the plurality of sorter carriages. The at least one collator is positioned along the conveying path and includes a plurality of bins. The collator is operable to selectively receive articles discharged from the sorter carriages in at least some of the bins such that articles are received by the bins of the collator in a sequenced manner. The collators may be operable to selectively move the collator bins relative to a respective discharge of the sorter carriages such that articles are received by the collator bins in a sequenced manner.

Therefore, the present invention provides an automatic single pass sequencing process for items or articles, such as packages of cards or the like. The present invention provides an automated means for sorting, queuing and presenting the sorted or sequenced articles to one or more output or discharge or unloading station. The sequencing process of the present invention sorts and sequences the items or articles to the desired sequence or delivery point sequence in a single pass or sort of a sorter. Because multiple collating devices may be positioned along the conveying path and may be operable to selectively receive different articles and/or different sequenced articles, the present invention accommodates different stores and orders. The present invention thus saves time and improves accuracy of sorting of the articles to a particular order or sequence.

These and other objects, advantages, purposes and features of this invention will become apparent upon review of the following specification in conjunction with the drawings.

DESCRIPTION OF THE PREFERRED EMBODIMENTS

Figure 3:
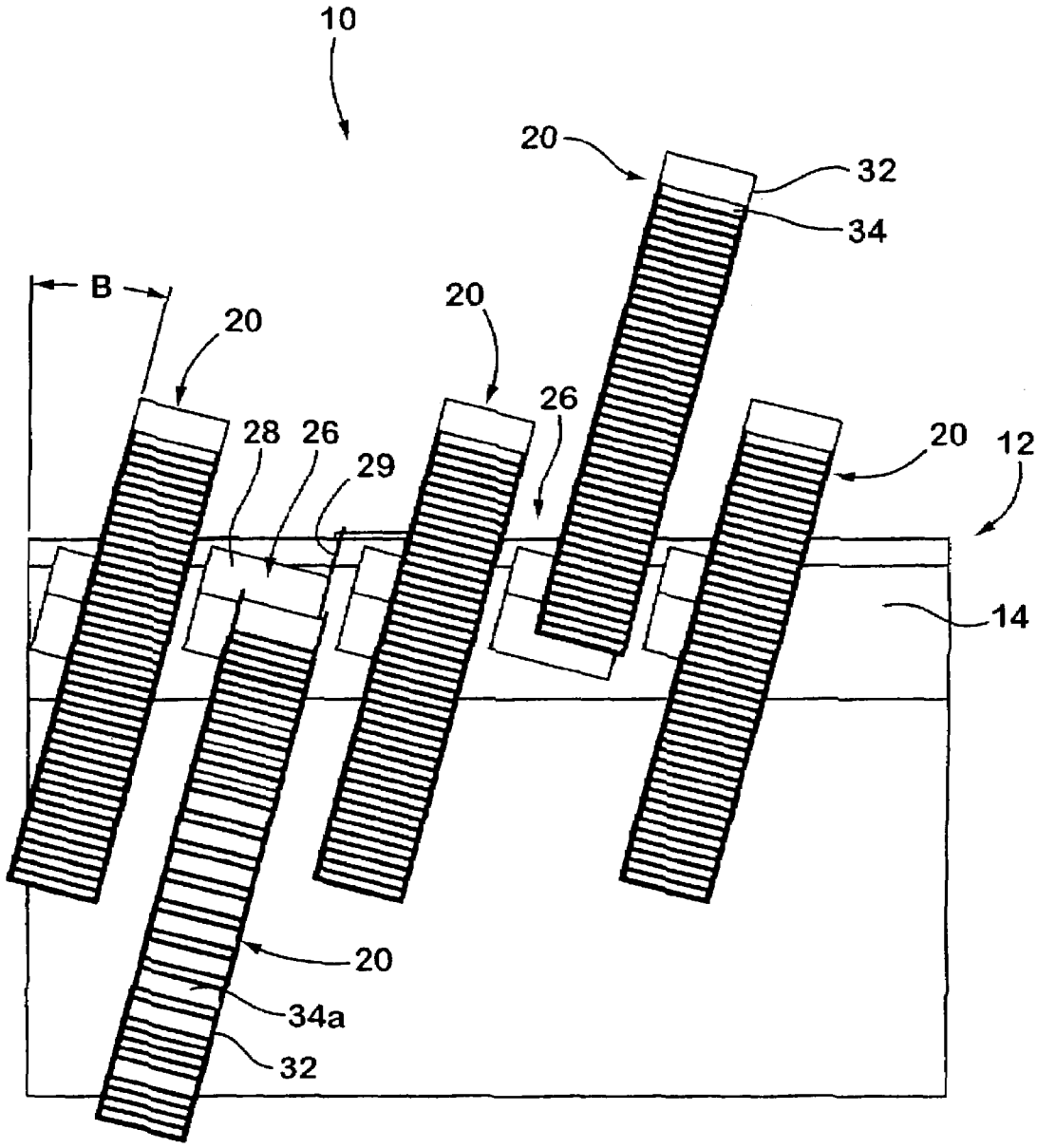
FIG. 3 is a side elevation of the sorter and sequencing assembly of FIGS. 1 and 2.
Figure 4:
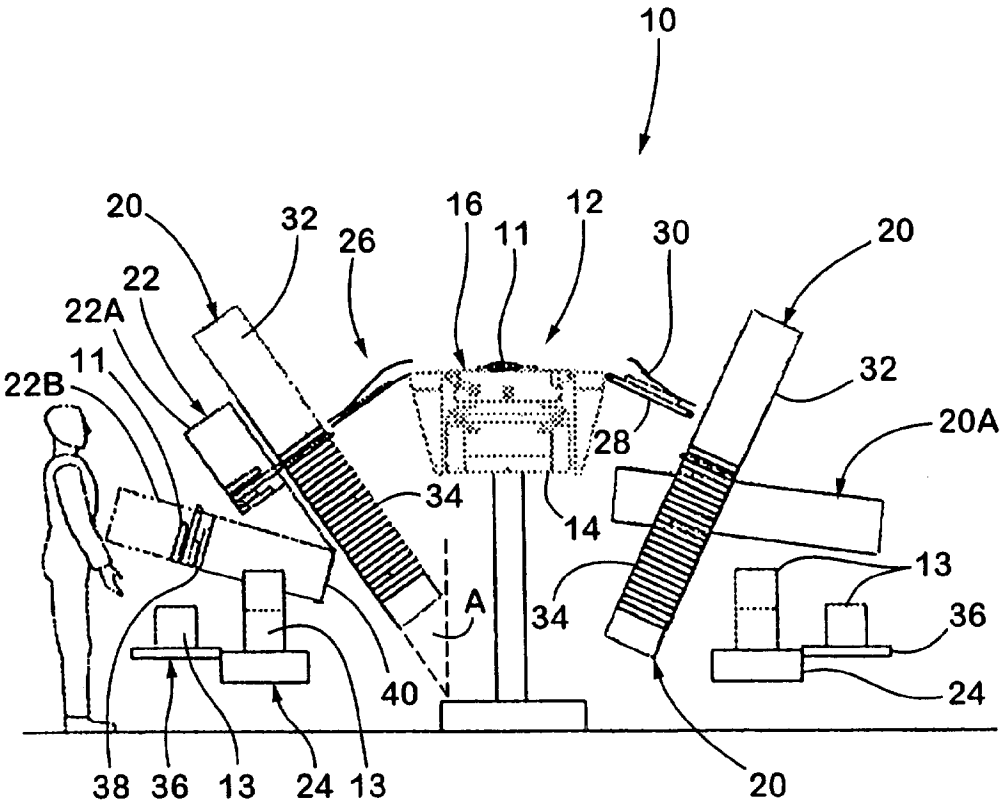
FIG. 4 is an end elevation of both sides of the sorting and sequencing assembly of FIGS. 1–3.
Figure 5:
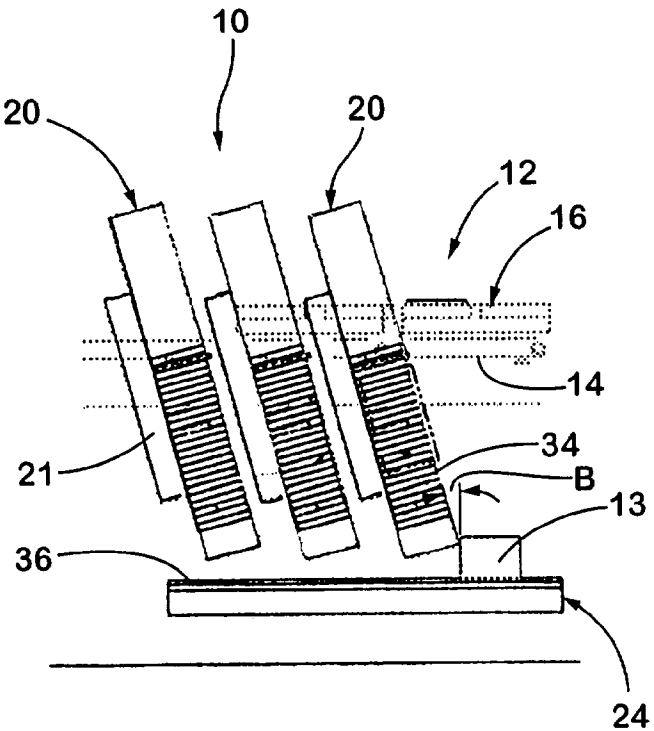
FIG. 5 is another side elevation of the sorting and sequencing assembly of FIGS. 1–4.
Figure 6:
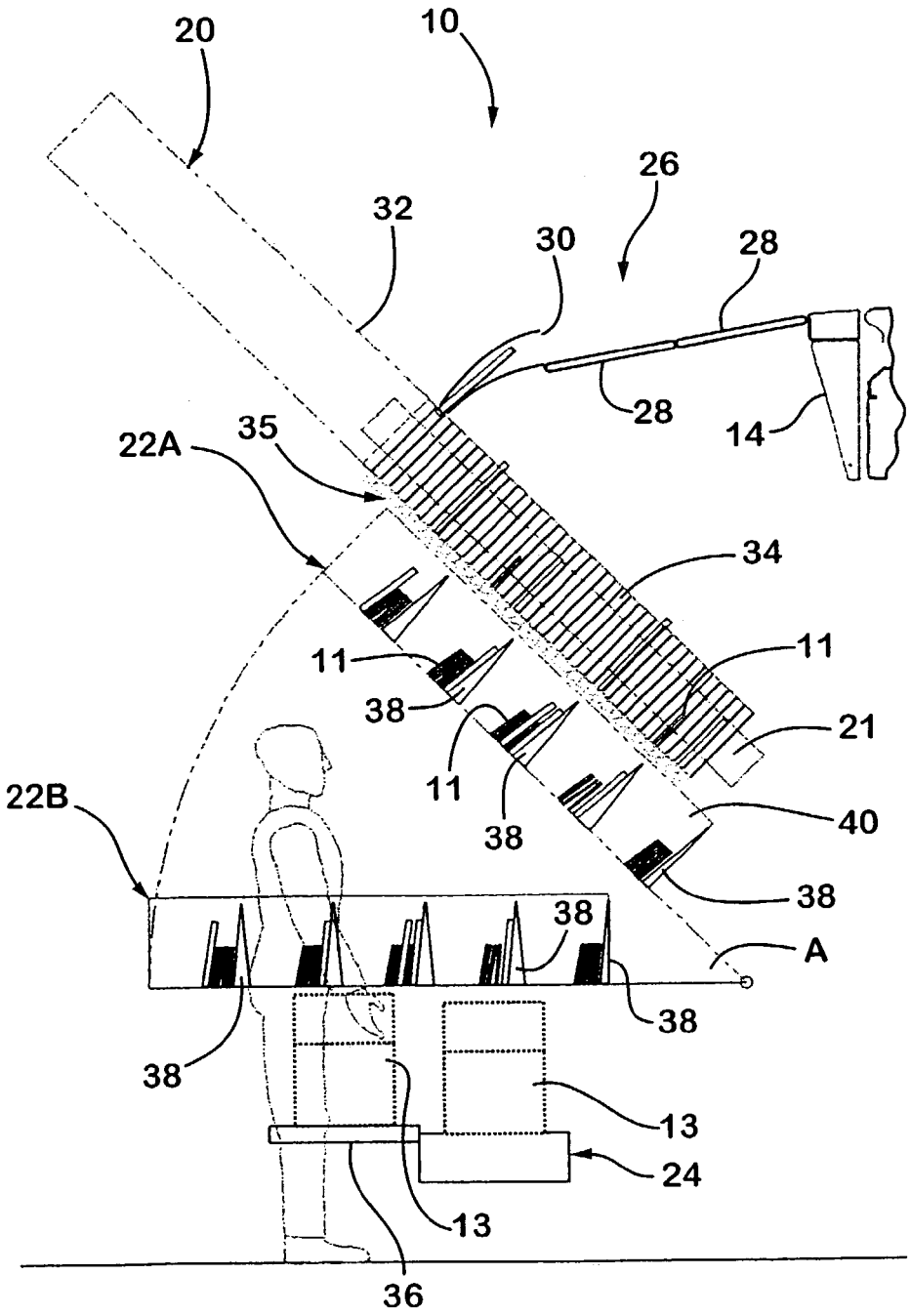
FIG. 6 is an enlarged end elevation of one side of the sorting and sequencing assembly of FIGS. 1–5.

Referring now to the drawings and the illustrative embodiments depicted therein, a single pass sortation system or sorting and sequencing system 10 includes a transport or sorter assembly or mechanism 12, which includes an endless conveying path 14 and a plurality of sorter carriages 16 movable along the endless conveying path 14 (FIGS. 1–7). At least one induct 18 (FIG. 7) is positioned along the conveying path 14 and is operable to load or induct articles onto sorter carriages 16 as the carriages are moved along the conveying path 14. A plurality of collating devices, cartridges, collators, magazines or article receivers 20 are positioned along the endless conveying path 14 and are operable to selectively receive articles 11 discharged from the carriages 16 in a desired order or sequence. The sorted and sequenced articles may then be manually removed from the collating devices 20 and placed or stacked in a container by an operator or may be automatically discharged into an appropriate container or carton 13 (FIGS. 4–6). Optionally, and preferably, a buffer device or collecting device or collector 22 is provided at each of the collating devices 20 to receive the sorted articles from collating device 20 and facilitate easier manual unloading of the sorted articles to a container on a discharge or shipping conveyor 24. The sortation system of the present invention is operable to sort or sequence articles to a delivery point sequence via a single sort pass of the articles, such that the articles are received at the collators or collectors in a delivery point sequence depth of sort.

The sorting and sequencing system of the present invention is particularly suited for sorting and sequencing packets of cards, such as greeting cards or the like. Such packets are typically packets of cards and vary in size from as large as approximately 0.75 inches thick and approximately twelve inches by approximately fifteen inches, to approximately 0.1 inches thick and approximately three inches by approximately three inches. However, the sortation system of the present invention may be adapted to sort and sequence other sized packages or articles, without affecting the scope of the present invention. The packets of cards are typically provided with approximately five cards and envelopes wrapped in a plastic wrap. However, the sortation system of the present invention may also or otherwise be operable to sort or sequence other articles, such as mail, compact discs, books or magazines or the like, without affecting the scope of the present invention. For example, aspects of the present invention may be implemented to sort flats mail to a delivery point sequencing depth of sort, such as for the U.S. Postal Service or other postal or parcel or shipping entity.

Sorter mechanism 12 is preferably a crossbelt sorter system, whereby the sorter carriages 16 include a continuous carrier belt which is movable to receive and discharge articles from and to either side of the conveying path 14. An example of a crossbelt sorter useful with the present invention is disclosed in commonly assigned U.S. Pat No. 5,588,520, which is hereby incorporated herein by reference. Optionally, the sorter mechanism may be a double width crossbelt sorter, such as disclosed in commonly assigned U.S. Patent applications, Ser. No. 09/675,237, filed Sep. 29, 2000 by Edwards et al. for DOUBLE WIDTH CROSSBELT SORTER, now U.S. Pat. No. 6,478,138; and Ser. No. 10/067,599, filed Feb. 4, 2002 by Cerutti et al. for ARTICLE SORTATION SYSTEM, now U.S. Pat. No. 6,889,814, which are hereby incorporated herein by reference. Briefly, each double width crossbelt sorter carriage includes a pair of side-by-side carrier belts which are operable to receive or discharge articles or to transfer articles from one of the belts to the other belt of the carriage. It is further envisioned that the sorter carriages may be other types of carriages or devices which are operable to receive articles from an induct, move articles along the conveying path, and discharge articles at a discharge station, such as, for example, tilt tray carriages or the like, without affecting the scope of the present invention.

Preferably, crossbelt sorter carriages 16 are connected together to form a generally continuous train of carriages movable along the conveying path 14. The sorter carriages 16 may be movable along conveying path 14 via any drive means, such as via the drive means disclosed in U.S. Pat. No. 5,588,520, which is hereby incorporated herein by reference. Sorter carriages 16 are operable to receive articles from induct or inducts 18 (FIG. 7) as the carriages move along the conveying path 14. The inducts 18 may be any known or conventional induct, or may be of the type disclosed in U.S. Pat. No. 5,588,520; and/or U.S. patent application Ser. No. 09/669,170, filed Sep. 25, 2000 by Affaticati et al. for HIGH RATE INDUCTION SYSTEM, now U.S. Pat. No. 6,513,641, which are hereby incorporated herein by reference, without affecting the scope of the present invention. It is further envisioned that the inducts or feeders may be of the type operable to induct flat articles on their edges (such as known in the industry), and may be further operable to orient the articles to a horizontal orientation before inducting the articles onto the sorter carriages, without affecting the scope of the present invention. The articles are identified, such as by a scanning device (not shown), such as at the induct or along the conveying path, and targeted or allocated to a particular bin of a particular collating device by a control system (also not shown). The sorter carriages then discharge the article at their respective particular collating devices, such as at a transfer assembly or discharge station or assembly 26.

As shown in FIGS. 1–4 and 6, a discharge assembly 26 is positioned at each collating device 20 to convey and/or guide the articles discharged from carriages 16 into collating device 20. Discharge assembly 26 may include one or more conveyors 28, such as belt conveyors or the like, to move or convey the articles to collating device 20. Also, a guide or chute 30 (FIGS. 4 and 5) may be provided to guide the articles toward the respective collating device and to prevent the articles from falling off of the conveyor 28 as the articles are conveyed to and discharged into collating device 20. The discharge assemblies 26 may be positioned generally orthogonal to the conveying path 14, or may be at an angle at least partially along the direction of the travel of the carriages, in order to accommodate the directional movement of the articles as they are discharged from the carriages (which may be continuously movable along conveying path 14), without affecting the scope of the present invention.

Conveyor belts 28 of discharge assembly 26 may be independently operable, and may be operable to receive articles from the sorter carriages and to temporarily accumulate or buffer the articles on the conveyor belts 28, in order to allow the collating device 20 to properly align one of the collator bins 34 with the discharge end of the belts 28, as discussed below. Optionally, the discharge guide or chute 30 may also or otherwise include a stop or door (not shown) which may be operable to close to temporarily buffer an article or stop an article from being discharged into one of the bins of the collating device, in order to allow the collating device sufficient time to align the appropriate bin with the discharge chute.

Figure 1:
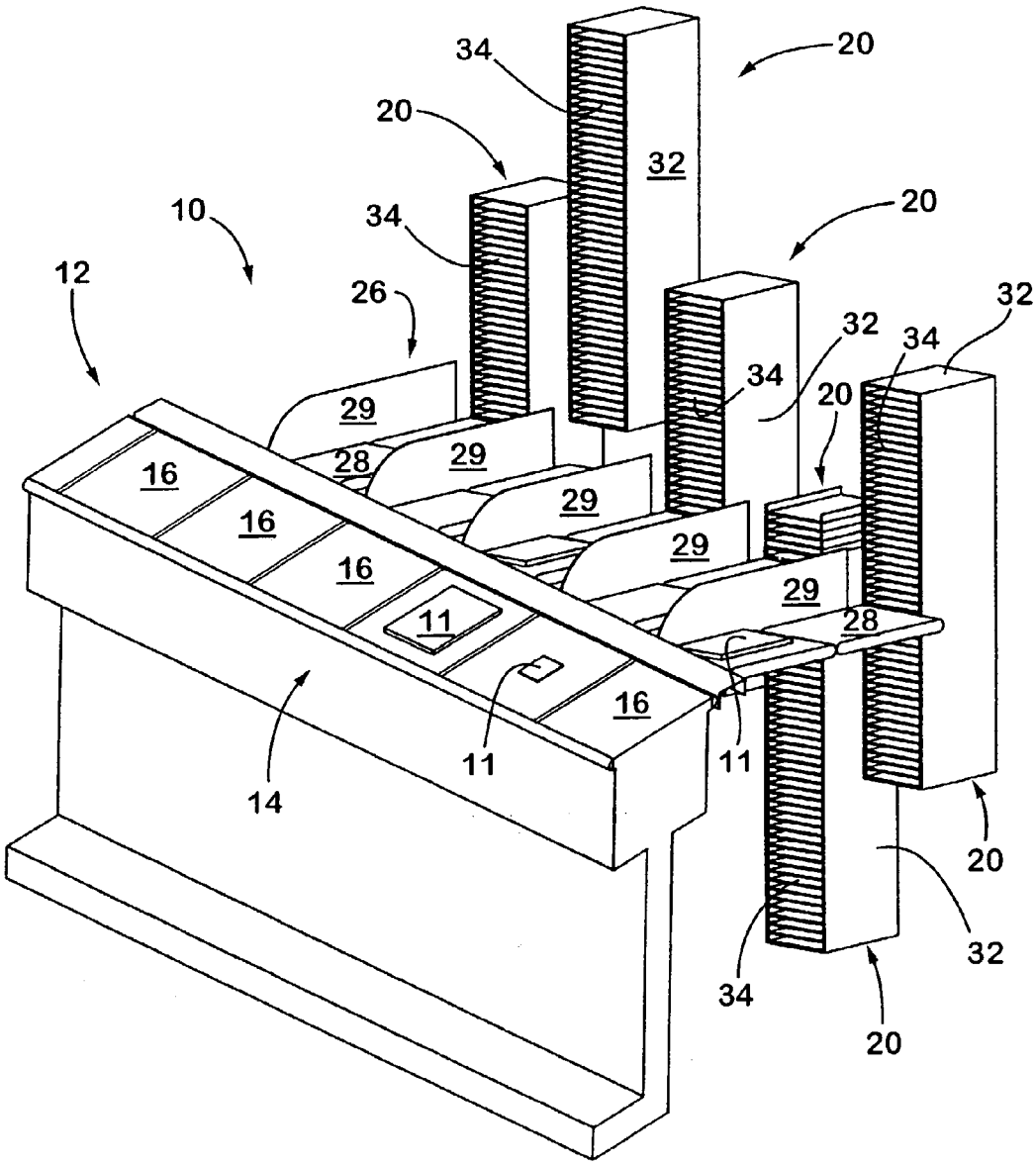
FIG. 1 is a perspective view of one side of a sorting and sequencing assembly in accordance with the present invention, with a plurality of collators being generally vertical and angled relative a sorter conveying path.
Figure 2:
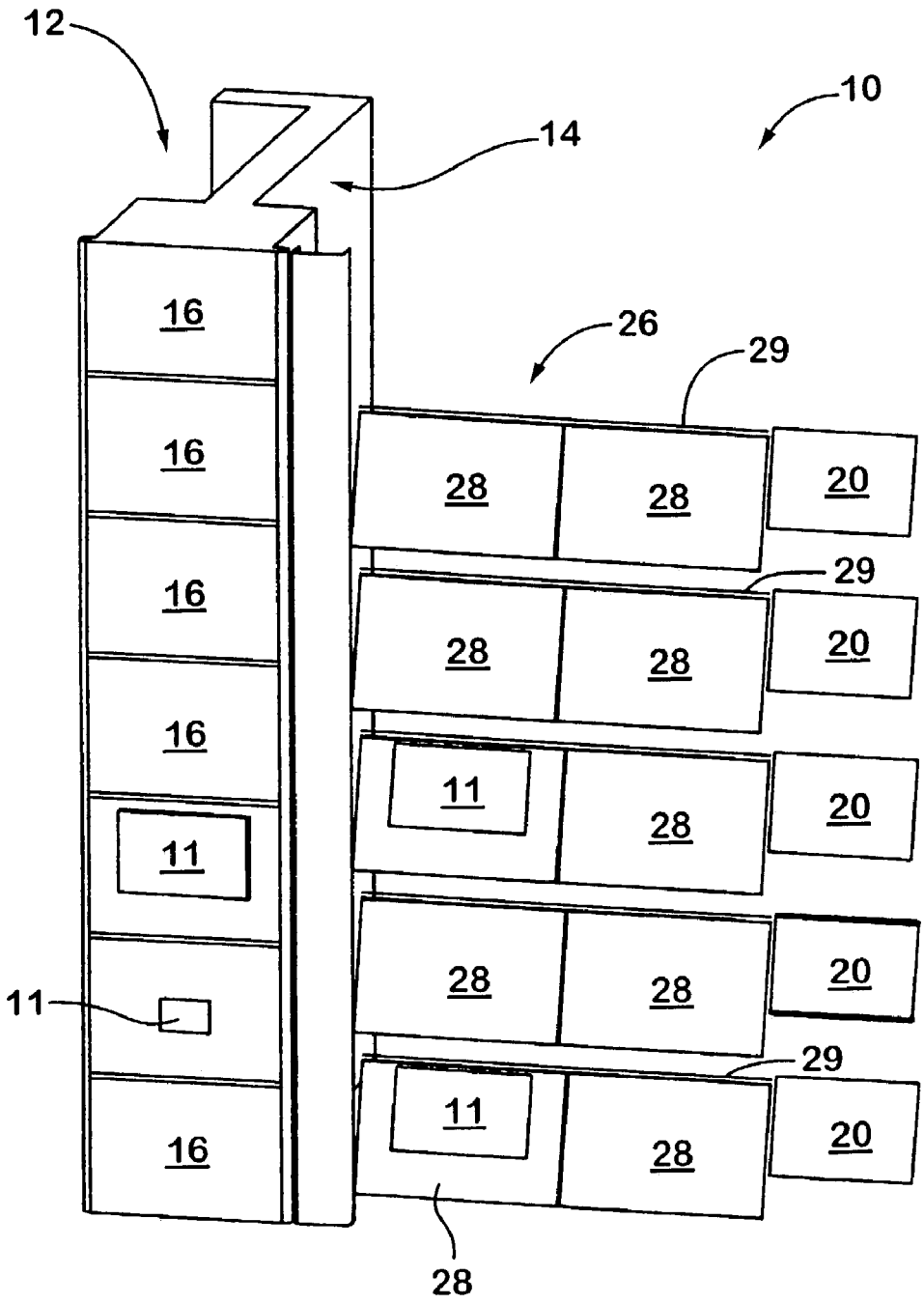
FIG. 2 is an upper perspective view of the sorting and sequencing assembly of FIG. 1.

As shown in FIGS. 1 and 3, conveyors 28 may be tilted toward one side to correspond with an angle of tilt of the collating devices 20 with respect to the conveying path 14, as also discussed below. A guide wall or alignment surface 29 may be provided along the lower side of the conveyors 28 to align and guide the articles 11 as they are conveyed by conveyors 28 toward collating device 20.

Each of the collating devices 20 includes a housing or frame structure 32 and a plurality of collator bins, slots or shelves 34 positioned along the frame structure 32. Each bin 34 is adapted to receive one or more articles, such as a packet or package of cards, from discharge assembly 26 at the respective collating device 20. As shown in FIG. 3, some of the bins 34*a* may be of a different size to accommodate different sized articles, without affecting the scope of the present invention.

As best seen in FIGS. 3–6, collating devices 20 may be tilted or angled in two directions, such as an angle A generally away from the conveying path 14 (as shown in FIGS. 4 and 6) and an angle B generally along the conveying path, such as with or against the direction of travel of the carriages 16 (as shown in FIGS. 3 and 5). In the illustrated embodiment of FIGS. 1–6, collating devices 20 are angled along the direction of conveyance at approximately 15 degrees (and the discharge conveyors 28 are also angled approximately 15 degrees to align with the bins of the collating devices). This allows the articles being received by the bins 34 to drop or move toward a corner of the bins 34. Because all of the articles, regardless of the size of the articles, are thus positioned in the same corner bins 34, the articles are generally aligned for easier removal from the collating device 20 by an operator, or are generally aligned to assist in maintaining the sequence or order of the articles as they are discharged or dumped from the collating device 20 to the collecting device 22, as discussed below.

Also, because the articles may be aligned along the discharge conveyors 28 in response to the tilt of the conveyors 28 and the guide wall 29, the minimum width of the bins 34 necessary to receive any of the sorted articles may be known or approximated. This is because the alignment of the articles along one side of conveyors 28 reduces or substantially precludes variance in the location of the articles as they are inducted into the collators, such that the bins may be wide enough to receive the widest or largest article, but do not have to be as wide as the discharge conveyors (or wide enough to receive the largest article plus some dimension to account for variance in the location of the article on the discharge conveyor). This allows for narrower collating devices, which provides additional floor space and/or additional space for the actuator and/or other components of the sorting and sequencing system of the present invention.

Collating device 20 is operable to move or adjustably position bins 34 relative to the discharge assembly 26 to generally align a particular bin with the discharge chute or conveyor for receiving an article from the discharge chute or conveyor which is targeted for that particular bin. Bins 34 may be movable via an actuator 21 (FIGS. 5 and 6) or any other drive means, such as via a servo motor, a pneumatic actuator device and/or the like, without affecting the scope of the present invention. Optionally, the collating devices 20 may be counterbalanced to ease the raising and lowering of the collating devices along their respective angles. In the illustrated embodiment, bins 34 of collating devices 20 are movable along collating devices 20 to align with the respective discharge assembly 26, such as belts 28 (FIGS. 1–3) or guide chute 30 (FIGS. 4 and 6). Optionally, each of the bins 34 may be adjustable to adjust an opening into the bin (such as the height of the bin) to increase the mouth of the bin as an article is being received into the bin, in order to provide a larger target for the article to be discharged into. After the articles of a sort wave or process have been received by at least some of the bins of the collating device, the articles are arranged or stacked in the desired order in the collating device and may be removed from the bins in the desired order or sequence.

In applications of the sortation system of the present invention where the collating devices 20 are manually unloaded or swept by an operator, the collating device 20 may be pivotable or tiltable to a generally horizontal orientation 20A, as shown on the right side of FIG. 4, such that the operator may easily access the bins 34 for unloading of the articles in the bins 34. The operator may unload the articles 11 and place or stack the sorted and sequenced articles in a container, carton or package 13, which may be positioned or placed on a shelf 36 at the operator's station. When the container 13 is filled or at least partially filled with the sorted articles 11, the container may be placed on shipping conveyor 24 and conveyed or transported to a discharge area for shipment of the container to the particular store. It is further envisioned that the pivotal or tilting movement of collating device 20 may be dampened or otherwise controlled to maintain a slow, controlled movement of collating device 20 toward the generally horizontal orientation 20A, in order to reduce or substantially preclude the possibility that an operator may be harmed during the lowering process.

Sortation system 10 may include buffer or collecting devices 22, which are initially positioned or oriented at a loading position 22A, which is generally parallel to the respective collating devices 20, as shown in FIGS. 4 and 6. In such applications of the sortation system of the present invention, the collating devices 20 include a door or doors 35 (FIG. 6), such as a trap door or the like, at a lower or downward side of each bin 34. Each door 35 is operable to pivot or slide open or otherwise open to discharge the article or articles from the respective bin 34 when the respective bin is properly aligned with the collecting device 22. As discussed below with respect to FIG. 18, the doors may be operable to simultaneously open, or may be individually opened, without affecting the scope of the present invention.

Each collecting device 22 includes a plurality of collector bins, slots or shelves 38 positioned along a frame or structure or housing 40. Bins 38 of collecting device 22 may be movable relative to bins 34 of collating device 20 to generally align the bins 38 and 34 (although the bins 32 of collating device 20 may be movable to generally align with the bins 38 of collecting device 22, without affecting the scope of the present invention). After bins 34 of collating device 20 are filled or at least partially filled by a sort wave or process (such as upon completion of a first sort wave or process), the bins 38 and 34 are aligned via movement of one or both of the bins relative to one another. When bins 38 of collecting device 22 are generally aligned with bins 34 of collating device 20, the doors 35 of bins 34 are sequentially or simultaneously opened to discharge, drop or dump the contents of each bin 34 into the appropriate bin 38 of collecting device 22 and in the appropriate order or sequence. The articles are then received in the appropriate order or sequence in collecting device 22.

After collecting device 22 has received the articles from collating device 20, collecting device 22 may be tilted or angled to a generally horizontal, unloading orientation or position 22B (FIGS. 4 and 6). As discussed above with respect to collating device 20, the pivotal or tilting movement of collecting device 22 may be dampened or otherwise controlled to maintain a slow, controlled movement of collecting device 22 toward the generally horizontal orientation 22B, in order to reduce or substantially preclude the possibility that an operator may be harmed during the lowering process. The openings to the bins 38 of collecting device 22 are then at an upper side of the collecting device, such that an operator may easily remove the contents or sorted articles from each bin 38 of collecting device 22. Because the collating device 20 is emptied into collecting device 22, the collating device 20 is then ready to receive additional articles from a subsequent sort wave or process. The collecting device 22 thus allows for substantially continuous sorting and sequencing of articles, since articles may be sorted and sequenced into the collating devices while the previously sorted articles are simultaneously removed from the respective collecting devices 22 by the operators.

Preferably, as shown in FIG. 6, collecting device 22 includes fewer bins or shelves than collating device 20. This allows for the contents of multiple bins 34 of collating device 20 (such as approximately five bins) to be sequentially loaded into a single bin of collecting device 22, which facilitates easier unloading of the sorted or sequenced articles from collecting device 22 by an operator. The operator may then remove multiple articles or a stack of multiple articles from a single bin 38 of collecting device 22 at a time, rather than individually remove each article from each bin 34 of collating device 20. In the illustrated embodiment, collecting device 22 includes five bins 38, whereas collating device 20 includes approximately forty bins 32. However, other quantities of bins or shelves for collecting device 22 and/or collating device 20 may be implemented, without affecting the scope of the present invention.

As the operator removes the articles from collecting device 22, the articles are placed or stacked in the container 13 at shelf 36. After the container has been filled or at least partially filled, the container is moved to the shipping conveyor 24 and conveyed to a discharge area for shipment to the targeted or appropriate store. If the container or carton requires more sequences than the collating device can hold, the carton may be spread over several waves or batches or adjacent collating devices, without affecting the scope of the present invention. In situations where an order of articles may also have more than one carton associated therewith, such multiple carton orders are preferably released together to the shipping area.

During operation of sortation system 10, packets of cards are inducted to the inducts along the conveying path or paths. The packets arrive at the induct stations and are loaded onto the sorter carriages in a generally random manner. The orientation of the articles on the sorter carriages may be such that the longer dimension of the article is in the direction of flow or discharge of the article at the sort station or collating device (generally perpendicular to the direction of travel of the crossbelt sorter carriages). The articles are identified and allocated or targeted for a particular bin of a particular collating device by the control system. The carriages transport the articles along the conveying path and discharge the articles at the respective discharge assembly at the targeted collating device.

The discharge assemblies transfer the articles from the sorter carriage to the collating device, and may buffer or delay transfer and/or delivery of the articles until the appropriate bin is aligned with the discharge assembly. The collating device is then operable to selectively receive the articles from the discharge assembly in an arranged or sequenced manner. The articles are then unloaded or swept from the collating device into corresponding cartons or containers, which are then moved or conveyed to a shipping area for shipment to the targeted or appropriate store or location. The articles may be unloaded from the collating device to a corresponding collecting device, such that the collating device may then continue to selectively receive articles in a sequenced manner as part of a subsequent sort process or wave, while the sequenced articles from the previous sort wave or process are unloaded from the collecting device by one or more operators. The operator then has sufficient time to unload the sequenced articles from the collecting devices, without affecting the sorting throughput, since the sorting process continues as the operator unloads the collecting device.

It is further envisioned that the collators may be operable to unload, drop or dump the articles in the collator bins directly into a shipping container. Such an automatic sweep process further reduces the manual interface necessary to unload the sequenced articles.

Order processing may place orders into a wave or sort process based on shipments. The wave size may be determined by the number of sort positions and the number of sequences for each carton or container. The wave may be pre-sorted to group many of the orders with the same identification numbers together. Multi-carton orders are preferably placed into the same wave and logical sorter so that the cartons leave the sorting area together. Each sort process or wave may be performed while the operators unload sorted articles from the collecting devices which were sorted or sequenced during a previous sort process or wave.

Figure 7:
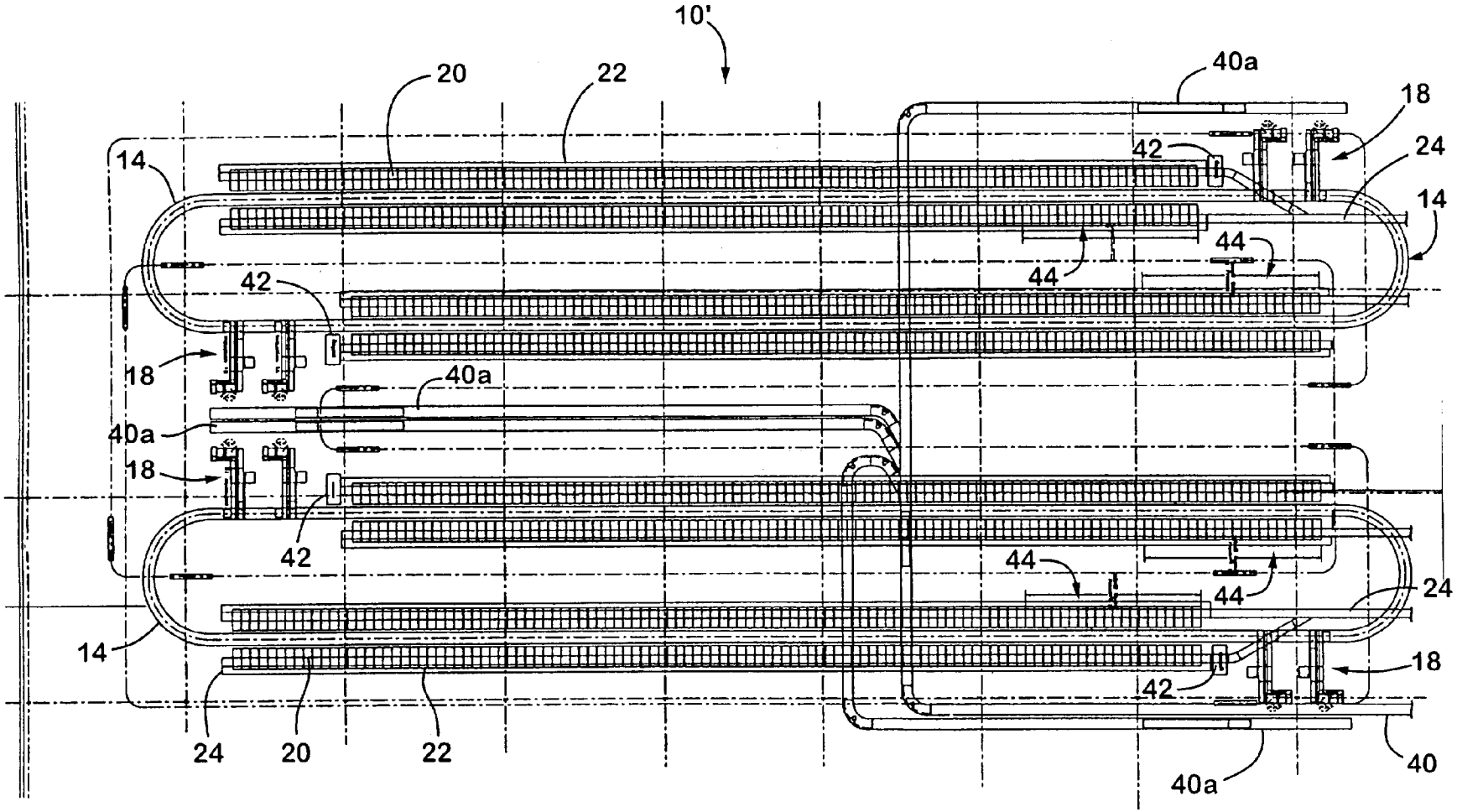
FIG. 7 is a top plan view of a sorting and sequencing assembly in accordance with the present invention, with two crossbelt sorter assemblies.

As shown in FIG. 7, a sortation system 10' may include two continuous conveying tracks or paths 14 and a plurality of sorter carriages 16 movable along each path 14. Each path may include at least one induct 18, such as four inducts in the illustrated embodiment with two inducts at each end of the conveying path, for inducting articles onto the sorter carriages 16. The inducts 18 may receive articles in a generally random manner from a respective one of at least one induct conveyor 40. In the illustrated embodiment of FIG. 7, induct conveyor 40 conveys articles to each of four pair of inducts 18 via four induct conveyors 40*a* which branch out from a single induct conveyor 40. It is envisioned that the sortation system 10' may include a presort process to presort the articles at the induct lanes 40*a*, in order to make sure that the inducts receive the appropriate articles for the corresponding collators. However, it is further envisioned that such a presort process may be reduced or obviated in applications having a double width crossbelt sorter of the type disclosed in commonly assigned U.S. patent applications. Ser. No. 09/675,237, filed Sep. 29, 2000 by Edwards et al. for DOUBLE WIDTH CROSSBELT SORTER, now U.S. Pat. No. 6,478,138; and Ser. No. 10/067,599, filed Feb. 4, 2002 by Cerutti et al. for ARTICLE SORTATION SYSTEM, now U.S. Pat. No. 6,889,814, which are hereby incorporated herein by reference.

The articles are thus inducted onto the sorter carriages in a generally random manner. The sorter carriages then transport the articles to an appropriate discharge site or collating device or article receiver 20, where the articles are discharged to an appropriate bin of the appropriate collating device. In the illustrated embodiment, the sortation system 10' includes approximately 800 collating devices positioned along both sides of the two conveying paths 14. The sortation system of the present invention may also include a reject discharge station or chute 42, which receives articles from the sorter carriages which were not discharged into an appropriate collating device, such as because of mismarking of the articles, no identification of the articles or any other reason which would preclude the article from being allocated to and/or discharged to an appropriate collating device along the conveyor path. Also, the sortation system of the present invention may include a small order and presort section of discharge stations 44 along the conveyor path, such as at one end of a row or rows of collating devices.

Figure 8:
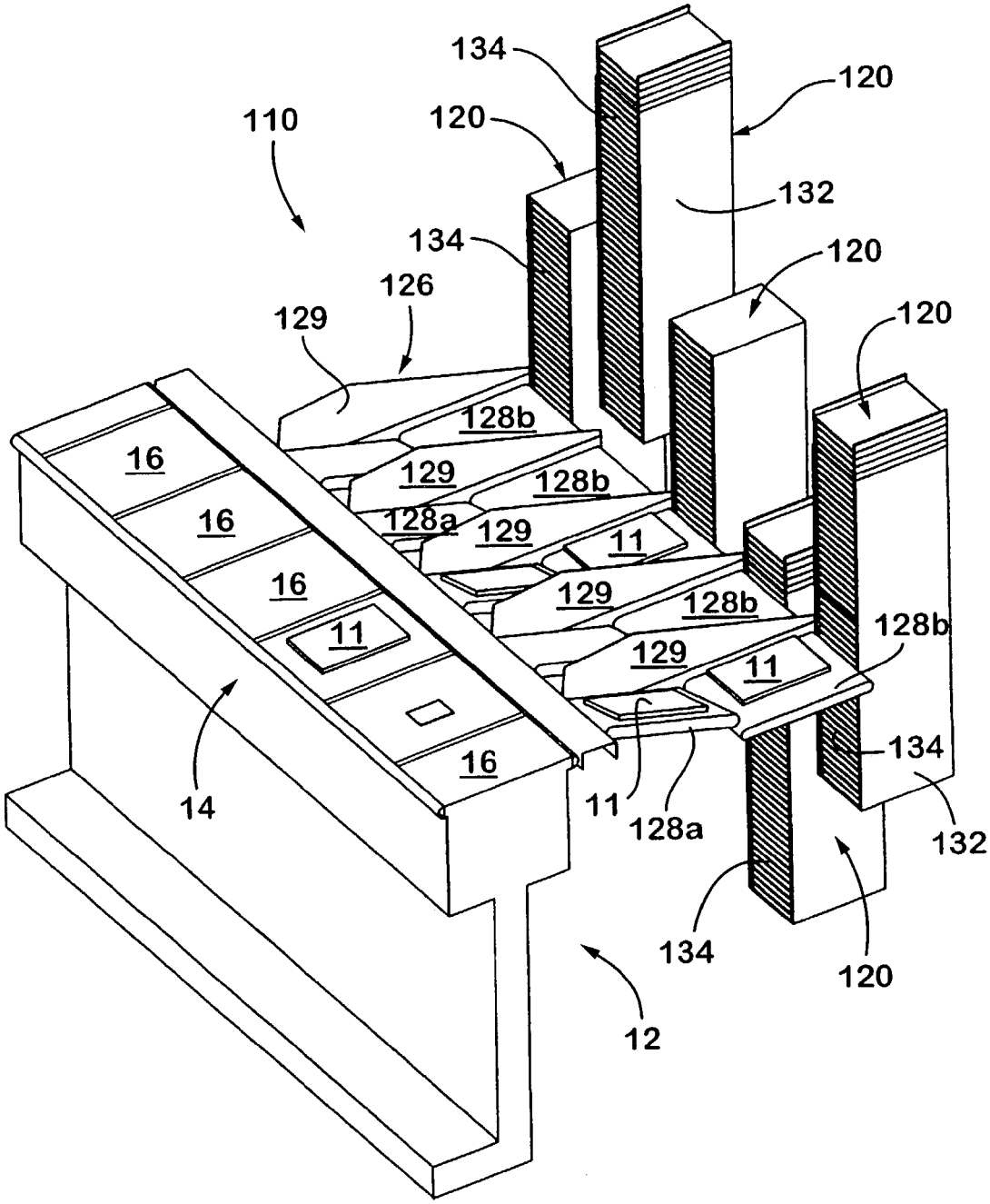
FIG. 8 is a perspective view of one side of another sorting and sequencing assembly in accordance with the present invention, with the collating devices being oriented generally vertically.
Figure 9:
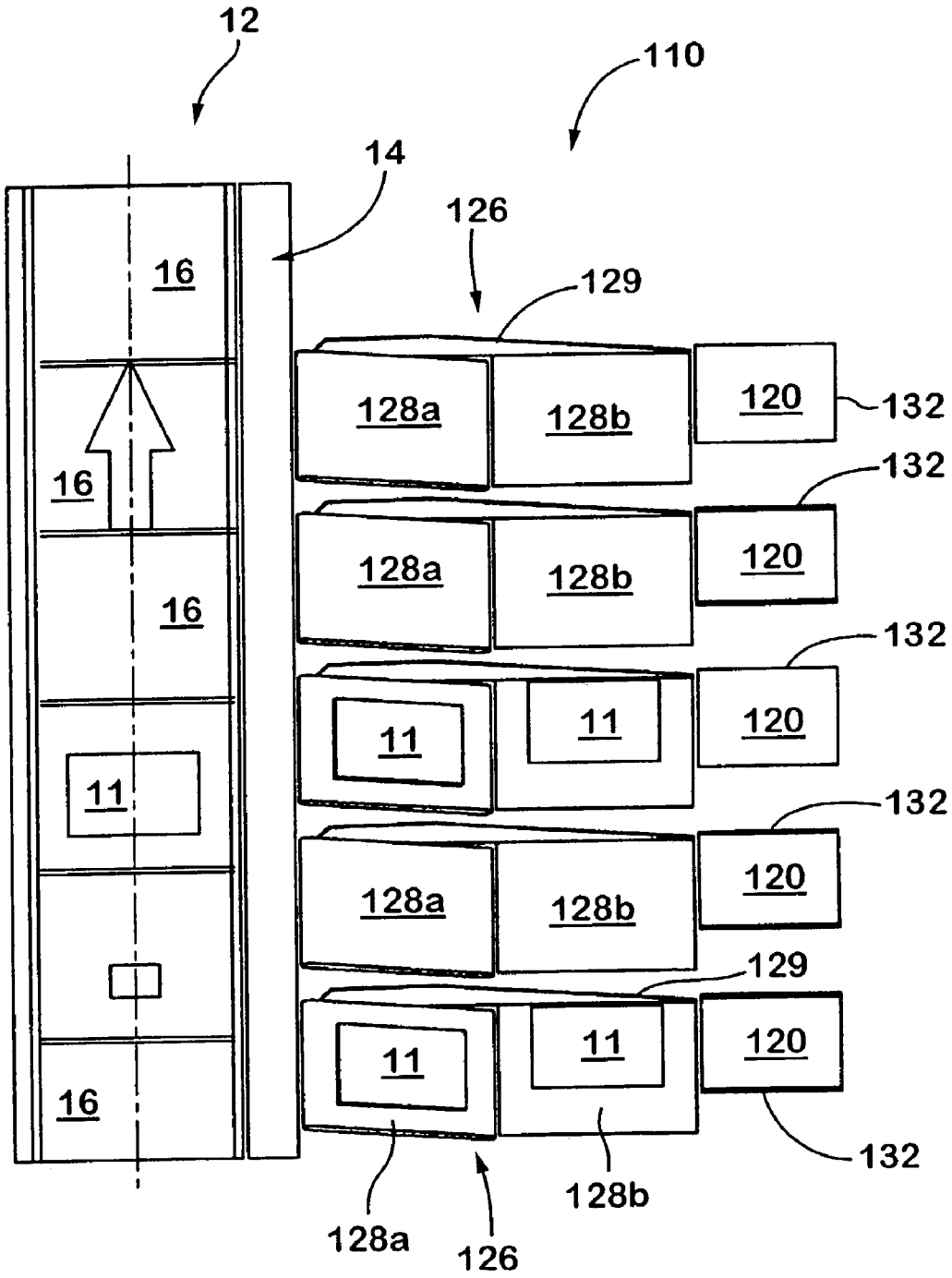
FIG. 9 is a top plan view of the sorting and sequencing assembly of FIG. 8.
Figure 10:
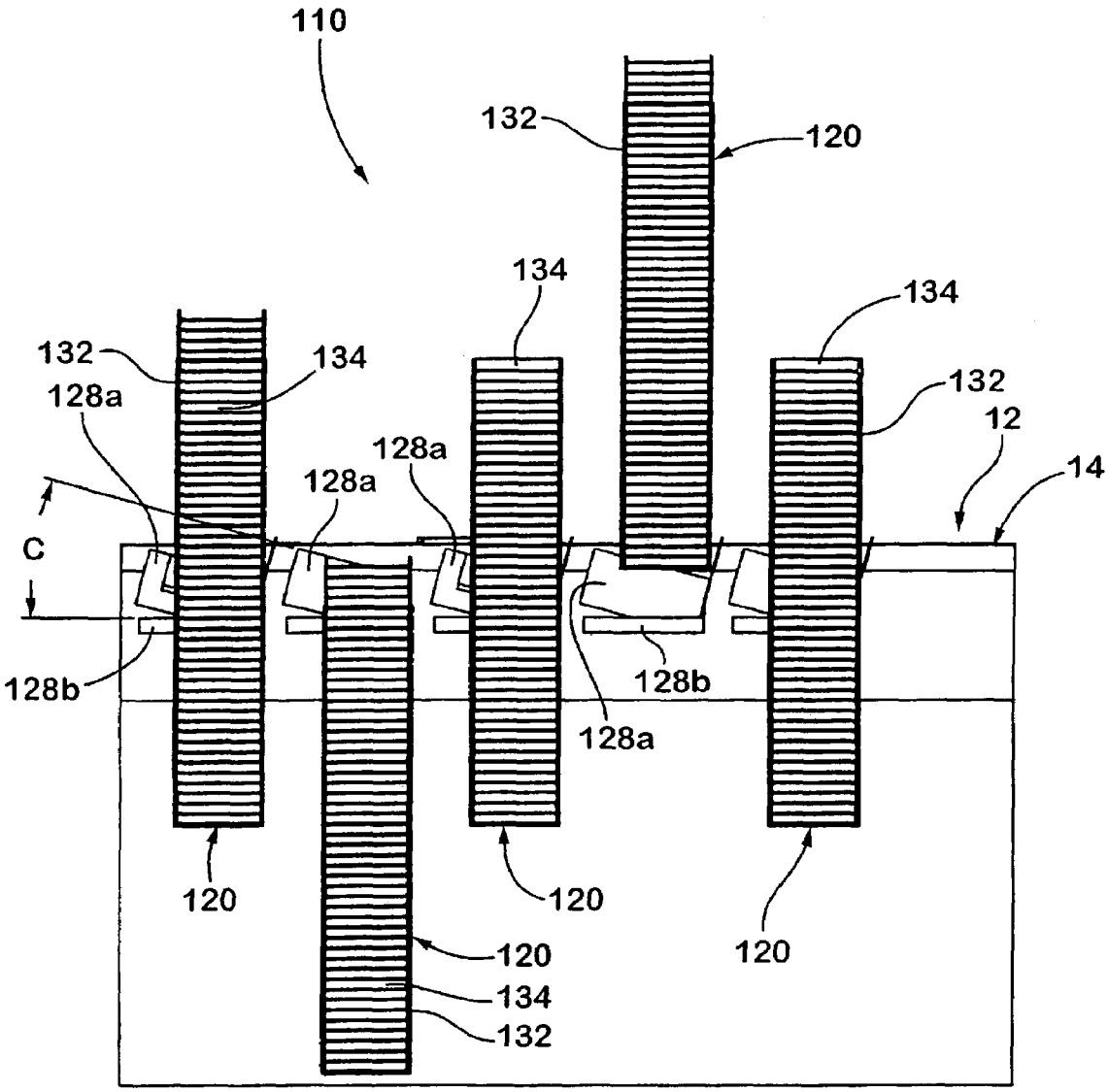
FIG. 10 is a side elevation of the sorting and sequencing assembly of FIGS. 8 and 9.

Referring now to FIGS. 8–10, a sortation system or sorting and sequencing system 110 in accordance with the present invention includes a plurality of generally vertically positioned or oriented collating devices or article receivers 120 positioned along conveying path 14 of sorter assembly 12. Sortation system 110 is substantially similar to sortation system 10, discussed above, such that a detailed description of the components will not be repeated herein. Suffice it to say that each collating device 120 includes a frame or structure 132 and a plurality of bins or slots 134, which are movable to generally align with a corresponding transfer or discharge assembly or system 126 of sorter assembly 12. Each collating device 120 is operable to selectively receive articles from a respective discharge assembly 126, such that the articles are arranged or stacked in the bins of each collating device in a desired or sequenced manner.

Each discharge assembly 126 includes a pair of discharge conveyors 128*a* and 128*b* which are operable to convey or transport articles 11 from the sorter carriages 16 to the corresponding collating device 120. As shown in FIGS. 8 and 10, discharge conveyor 128*a* is tilted or angled at an angle C (FIG. 10) toward one side of discharge conveyor 128*a* to cause the articles to shift or move to one side of conveyor 128*a*, while the second discharge conveyor 128*b* is generally horizontally oriented to align with the generally horizontal bins 134 of vertical collating devices 120. A generally vertical guide wall or surface 129 is provided along the lower side of discharge conveyor 128*a* to align the articles therealong and to prevent the articles from falling off of discharge conveyor 128*a*. The articles are then aligned along one side of the discharge conveyors to minimize variance in location of the articles on the conveyors, as discussed above. Similar to discharge assembly 26, discussed above, discharge assembly 126 may be operable to accumulate or buffer articles, such as on one or both of conveyors 128*a*, 128*b* or at a discharge chute (not shown in FIGS. 8–10), to delay delivery of the articles to the bins 134 of collating device 120 until the appropriate bin is properly aligned with discharge conveyor 128*b*.

After the bins or slots 134 of collating device 120 have been filled or at least partially filled with articles discharged from the sorter carriages 16, the bins 134 may be generally aligned with a respective one of a plurality of collector bins of a collecting assembly (not shown in FIGS. 8–10), such as discussed above with respect to sequencing assembly 10. Optionally, the collating devices 120 may be tiltable or movable to a generally horizontal orientation (also not shown in FIGS. 8–10) to facilitate manual unloading of the bins by an operator.

Figure 11:
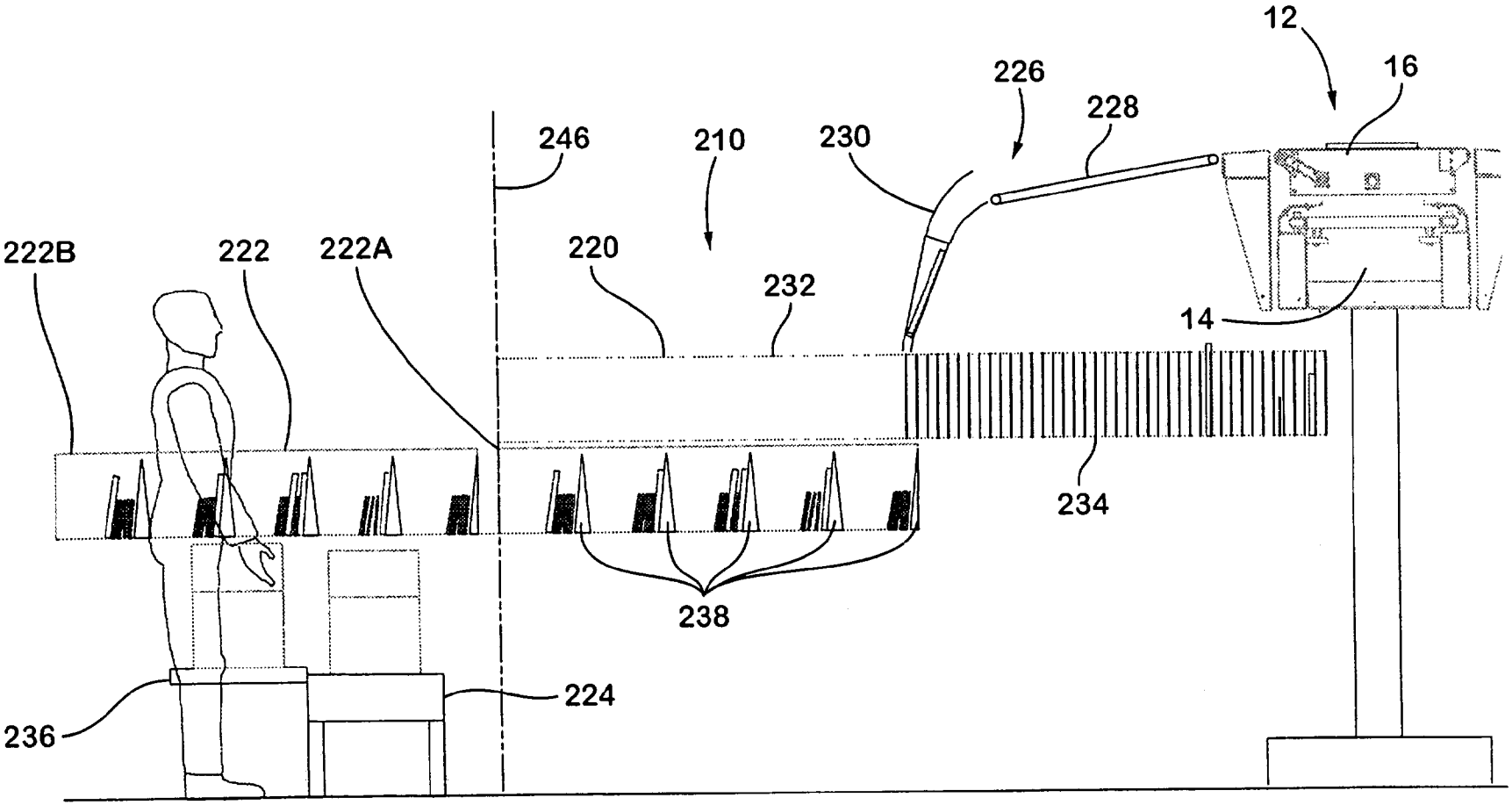
FIG. 11 is an end elevation of another sorting and sequencing assembly in accordance with the present invention, with the collating devices being oriented generally horizontally.
Figure 12:
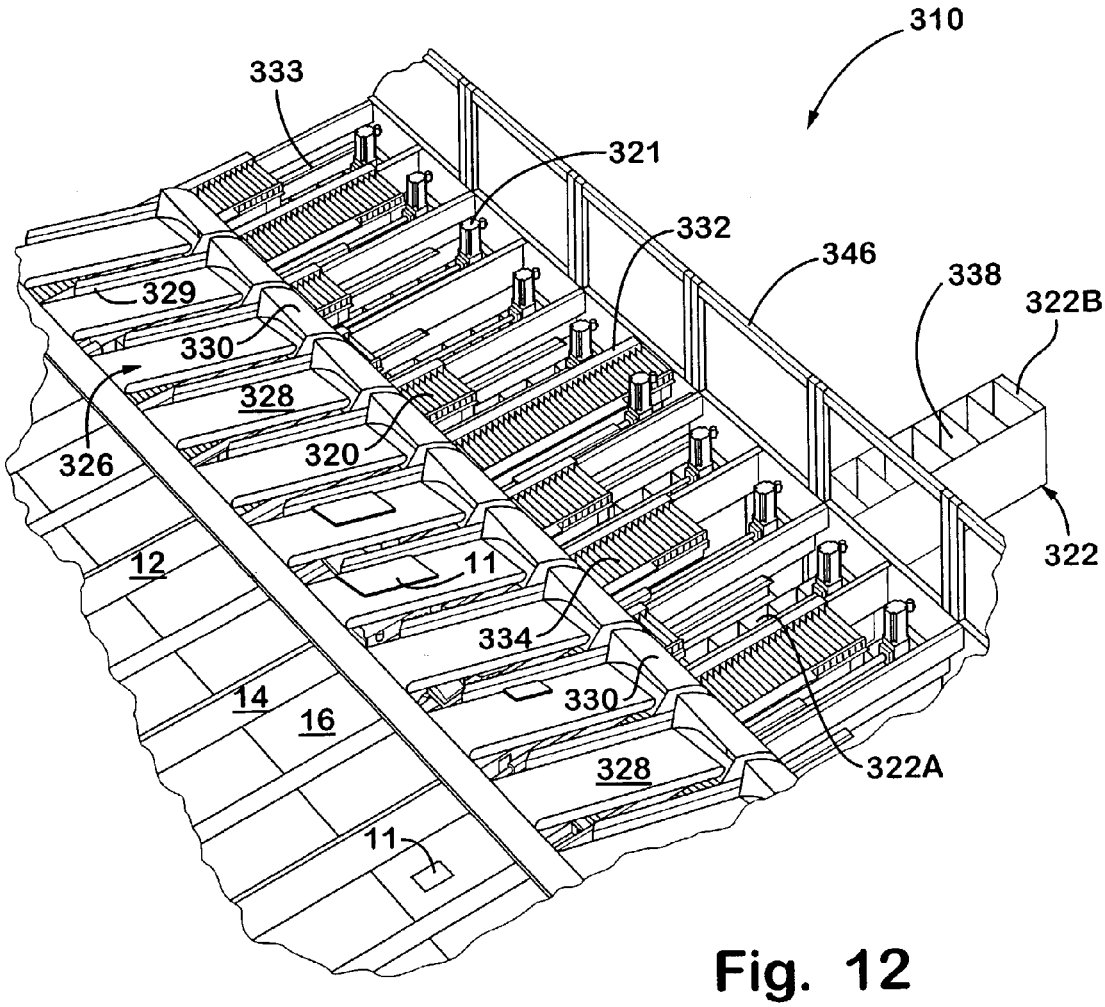
FIGS. 12–16 are upper perspective views of a sorting and sequencing assembly in accordance with the present invention, with generally horizontally oriented collating devices.
Figure 13:
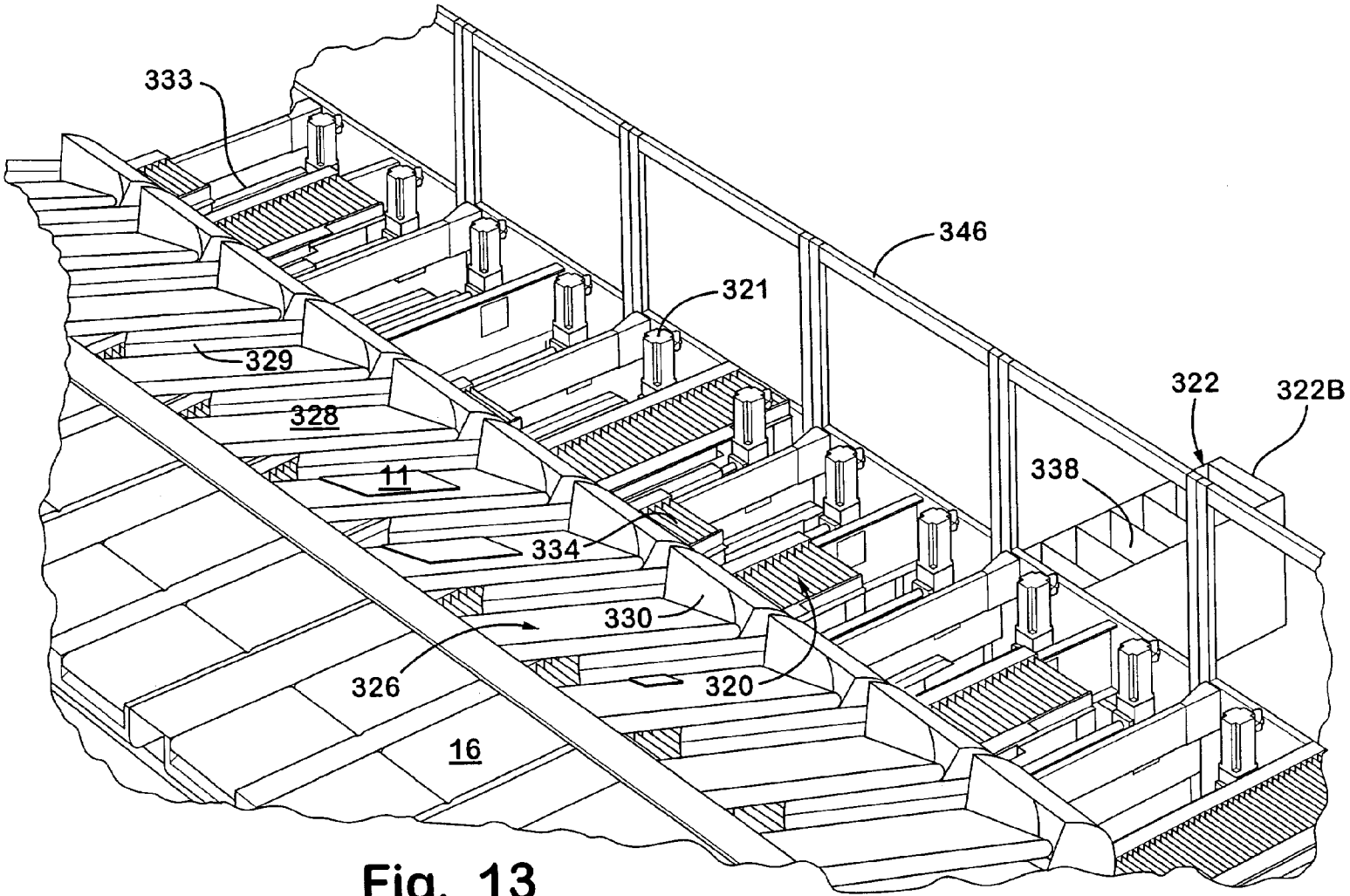

Referring now to FIG. 11, a sortation system or sorting and sequencing system 210 in accordance with the present invention includes a plurality of generally horizontally positioned or oriented collating devices or article receiving devices 220 positioned along a conveying path 14 of a sorter assembly or transport assembly 12. Sortation system 210 is substantially similar to sortation systems 10, 110, discussed above, such that a detailed description of the components will not be repeated herein. Suffice it to say that each collating device 220 includes a frame or structure 232 and a plurality of bins or slots 234, which are movable to generally align with a transfer or discharge assembly or system 226 of sorter assembly 12. The discharge assembly 226 includes a discharge conveyor 228 and a discharge or outlet chute 230. As shown in FIG. 11, discharge chute 230 is angled or curved to direct the articles downward into the bins 234 of the corresponding collating device 220. Similar to discharge assembly 26, discussed above, discharge assembly 226 may be operable to accumulate or buffer articles, such as on conveyor 228 and/or in chute 230 (such as via a door or stop (not shown) at or in chute 230), to delay delivery of the articles to the bins of collating device 220 until the appropriate bin is properly aligned with discharge chute 230.

After the collator bins 234 have been filled or at least partially filled with articles discharged from the sorter carriages 16, the bins 234 are movable to align with a respective one of a plurality of collector bins or slots 238 of a generally horizontally positioned or oriented buffer or collecting device 222. Collecting device 222 may be movable under collating device 220 (such as in a file drawer type manner) to align the bins 234, 238, and/or the bins 234 of collating device 220 may be movable over collecting device 222 to align the bins, without affecting the scope of the present invention.

After the bins 234, 238 are generally aligned, each of the bins 234 of collating device 220 may be opened in a desired order or sequence (or may be opened generally simultaneously) to discharge or drop the articles into the appropriate bins of collecting device 222 in the desired order or sequence. The collecting device 222 may then be moved from a loading position 222A to an unloading position 222B, where an operator may unload the sequenced articles from collecting device 222 into a container or carton, such as at a shelf 236. The filled container may then be placed onto a shipping conveyor 224 where it is conveyed to a discharge area for shipment to the targeted or appropriate store or location. Similar to sortation system 10, discussed above, collating device 220 may resume selectively receiving articles from the sorter carriages and discharge assembly while the corresponding collecting device 222 is being simultaneously unloaded by the operator.

Because the collecting device 222 is oriented generally horizontally, the collecting device may be slid horizontally between the loading and unloading positions. This is advantageous in applications where a safety wall or fence 246 may be erected around the collating devices and discharge chutes. In such applications, the horizontally oriented collecting devices 222 may be slid, such as in a similar fashion as a drawer, through the wall and into the loading position 222A. After loading of collecting device 222 is complete, the collecting device 222 may then be slid outward from the wall to the unloading position 222B. Accordingly, the operator or unloading station may be positioned outside of the wall 246.

Referring now to FIGS. 12–18, a sortation system or sorting and sequencing assembly 310 in accordance with the present invention includes a plurality of generally horizontally positioned or oriented article receivers or collating devices 320 positioned along a conveying path 14 of a sorter assembly or transport assembly 12. Sortation system 310 is substantially similar to sortation systems 10, 110, 210 discussed above, such that a detailed description of the components will not be repeated herein. Suffice it to say that each collating device 320 includes a housing or structure 332 and a plurality of bins or slots 334 (such as approximately 40 slots). Each collating device 320 is movable to generally align with a respective transfer or discharge assembly or system 326 of sorter assembly 12 to selectively receive articles and to arrange the articles in an arranged or sequenced manner in the bins 334. Each collating device 320 includes a frame or track portion 333, along which the housing 332 is movable generally horizontally to selectively move the appropriate bin 334 into alignment with the discharge assembly 326 for receiving an article therefrom.

Each discharge assembly 326 includes a discharge conveyor 328 and a discharge or outlet chute 330. Discharge chute 330 is angled or curved to direct the articles downward into the bins 334 of the corresponding collating device 320. Similar to discharge assembly 26, discussed above, each discharge assembly 326 may be operable to accumulate or buffer articles, such as on conveyor 328 and/or in chute 330 (such as via a door or stop (not shown) at or in chute 330), to delay delivery of the articles to the bins of the corresponding collating device 320 until the appropriate bin is properly aligned with discharge chute 330. Also, similar to discharge conveyors 28 discussed above, discharge conveyors 328 may be tilted toward one side to shift the articles toward a lower side of the conveyors 328. The discharge assembly 326 may include a guide wall or alignment surface 329 along the lower side of each of the tilted conveyors 328 to align and guide the articles 11 as they are conveyed by conveyors 328 toward the chute 330 and collating devices 320.

The articles are conveyed along alignment surface 329 of a particular conveyor 328 toward and into a corresponding discharge chute 330. The chute 330 guides the articles such that the articles are discharged from the chute in a generally vertical direction toward the corresponding collating device 320. Because the articles are aligned along one side of conveyor 328, the articles are deposited into the bins 334 of collating device 320 and are positioned generally along one side of the collating device 320. The collating device 320 is movable, such as via a motor or actuator 321 or any other means for moving the collating device bins generally linearly (such as along frame 333), relative to the discharge end of the chute 330 to align an appropriate bin 334 of the collating device 320 with the discharge end of the chute to receive the particular article being discharged from the chute.

After at least some of the bins 334 of the collating device 320 have been filled or at least partially filled with articles discharged from the sorter carriages 16, the collator bins 334 are movable to an unloading position where they are positioned generally above a collecting device 322. The collator bins 334 are generally aligned with respective ones of a plurality of collector bins 338 of the respective generally horizontally positioned or oriented buffer or collecting device 322 positioned generally beneath collating device 320. Each bin 338 of collecting device 322 may be configured to receive articles from multiple bins 334 of collating device 320 (such as, for example, from five collator bins 334). In the illustrated embodiment, the collecting devices 322 are movable under the collating devices 320 (such as in a file drawer type manner) between a loading position 322A and an unloading position 322B. The bins 334 of collating device 320 may be movable over the bins 338 of collecting device 322 to align the bins, or the collecting device may be moved under the collating device 320 to align the bins, without affecting the scope of the present invention.

Figure 18:
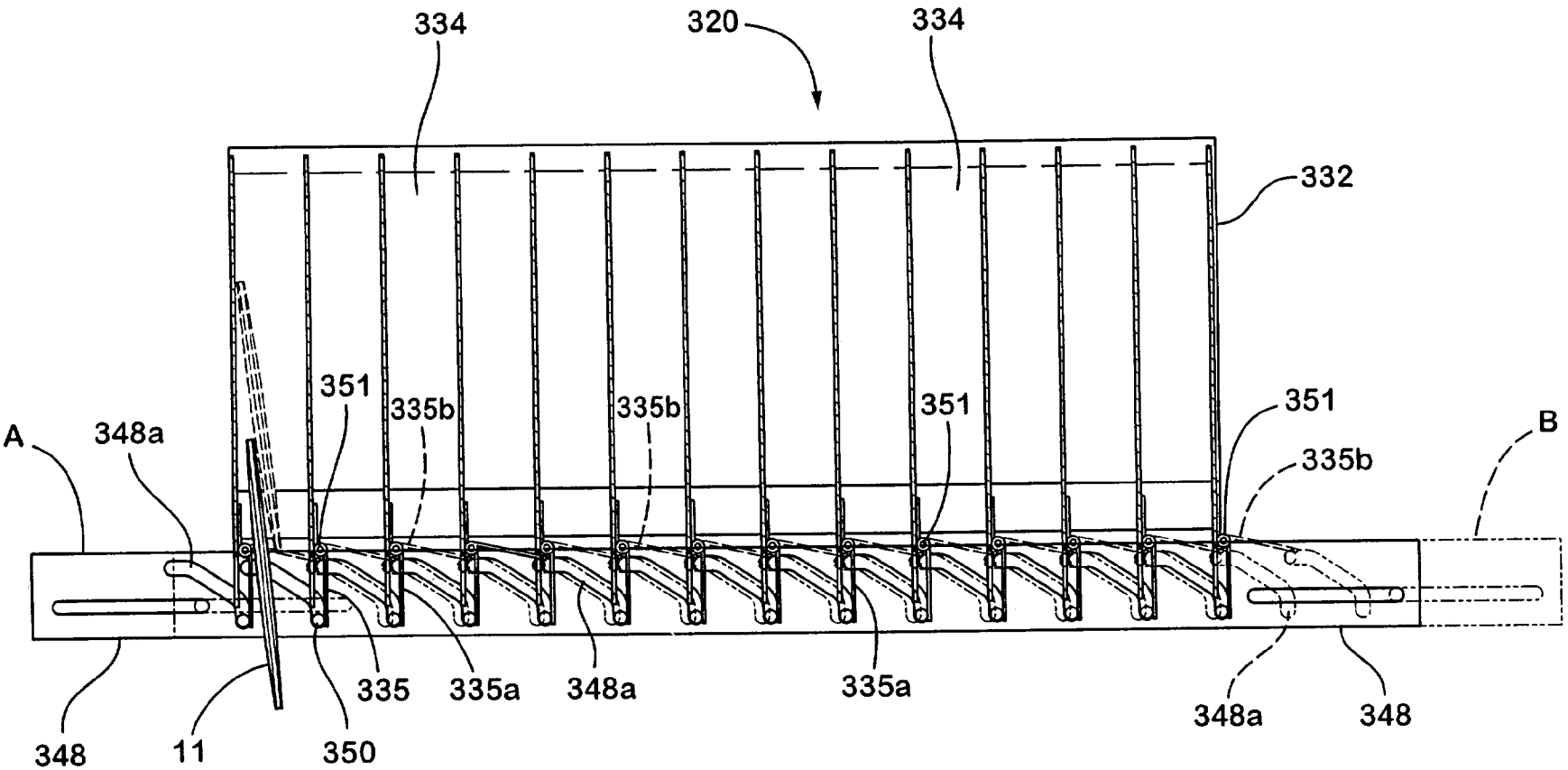
FIG. 18 is a side view of a collating device in accordance with the present invention, showing the doors and door opening mechanism for the bins of the collating device.

After the collecting device 322 is moved to its loading position 322A and the bins 334, 338 are generally vertically aligned, each of the bins 334 of collating device 320 may be opened, such as all together or in a desired order or sequence, to discharge or drop the articles into the appropriate bins of collecting device 322. As shown in FIG. 18, all of the bins 334 of a collating device 320 may include a pivotable door or bottom 335 at their lower end. In the illustrated embodiment of FIG. 18, the doors 335 are opened together to simultaneously discharge the articles from all of the bins 334 into the corresponding bins 338 of the collecting device 322. Each door 335 includes a guide pin 350 opposite its hinge 351. The guide pin 350 is inserted through a corresponding arcuate slot 348*a* of a door actuating mechanism or bar 348. The doors 335 are pivoted to their open position in response to movement of the door actuating mechanism or bar 348. More particularly, as bar 348 is moved generally horizontally along the collating device 320, the slots 348*a* cause the respective guide pins 350 to move along the slots to cause the doors to pivot about their hinges or pivot axes 351 toward an open or closed position, depending on the direction of movement of bar 348 relative to the doors. In the illustrated embodiment of FIG. 18, movement of the bar 348 to the left (position A, shown in solid lines) causes the doors 335 to move toward their open position 335*a*, while movement of the bar 348 to the right (position B, shown in phantom) causes the doors 335 to move toward their closed position 335*b*. Thus, all of the doors 335 of the bins 334 of a particular collating device 320 are opened simultaneously via movement of a single bar or actuating mechanism 348 along the particular collating device 320. The door actuating mechanism or bar may be moved via a linear actuator or the like (not shown) or any other means for imparting a generally translational movement of the bar along the collating device, without affecting the scope of the present invention.

After the articles have been discharged from the opened bins 334 of the collating device 320 into the bins 338 of the collecting device 322, the doors 335 of the bins 334 may be closed, such as via movement of the bar 348 in the opposite direction, and the collating device 320 may resume selectively receiving articles from the sorter carriages 16 and discharge assembly 326. While the collating device receives articles in a second sort wave or process, the collecting device 322 may be moved from the loading position 322A to the unloading position 322B, where an operator may unload the sequenced articles from collecting device 322 into a container or carton, such as at a shelf or the like (not shown). The filled container may then be placed onto a shipping conveyor where it is conveyed to a discharge area for shipment to the targeted or appropriate store or location.

Figure 14:
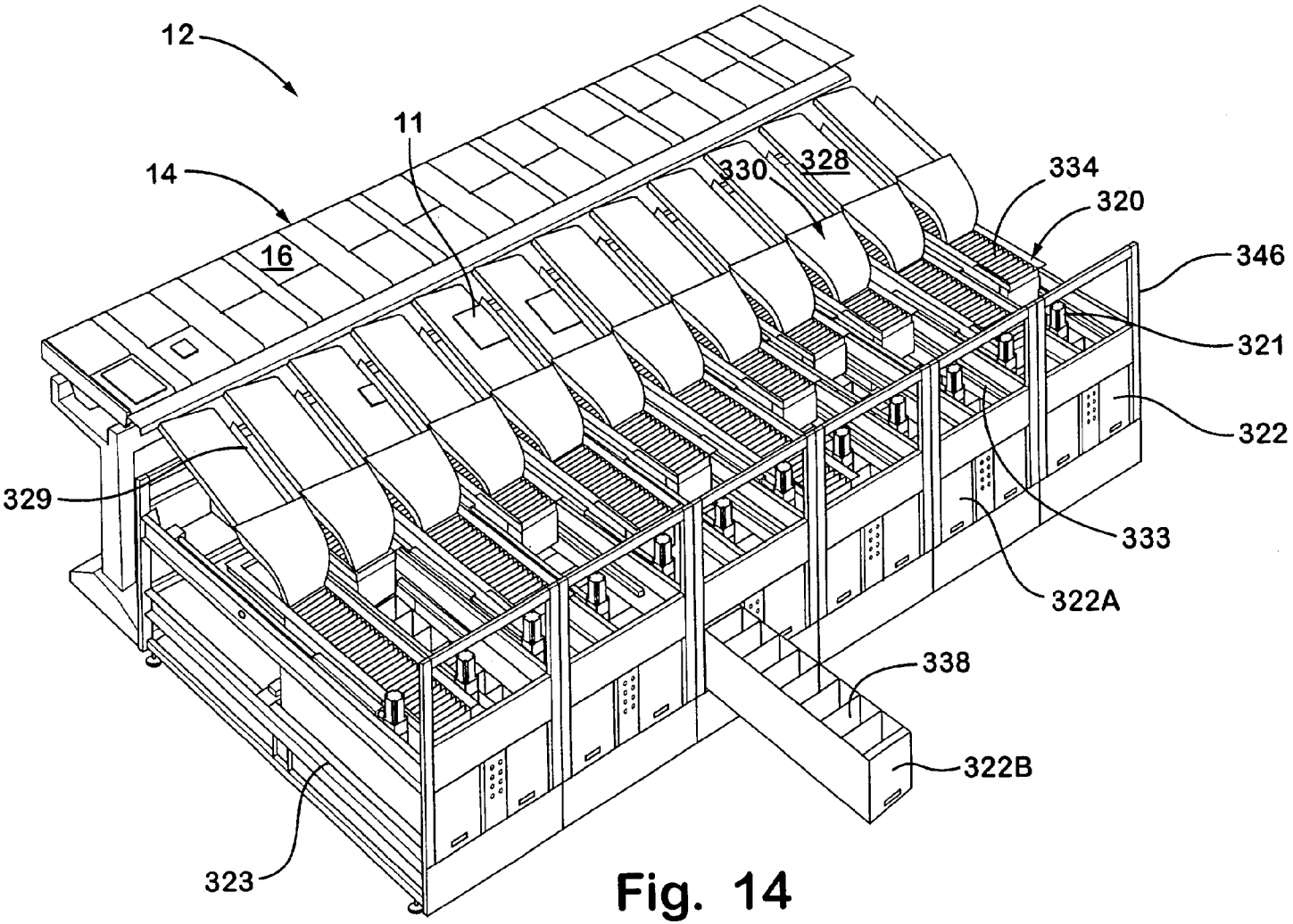
Figure 15:
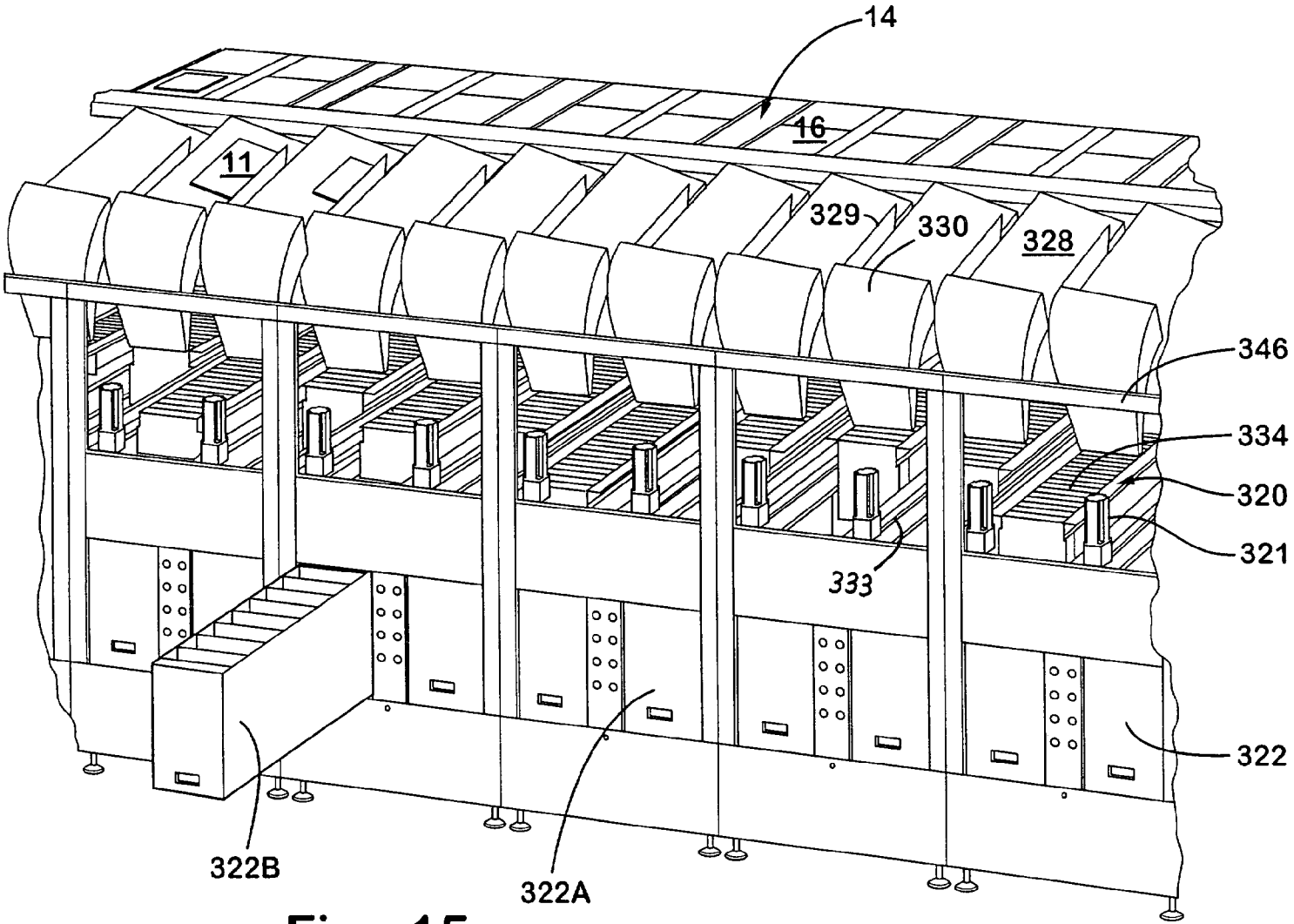
Figure 16:
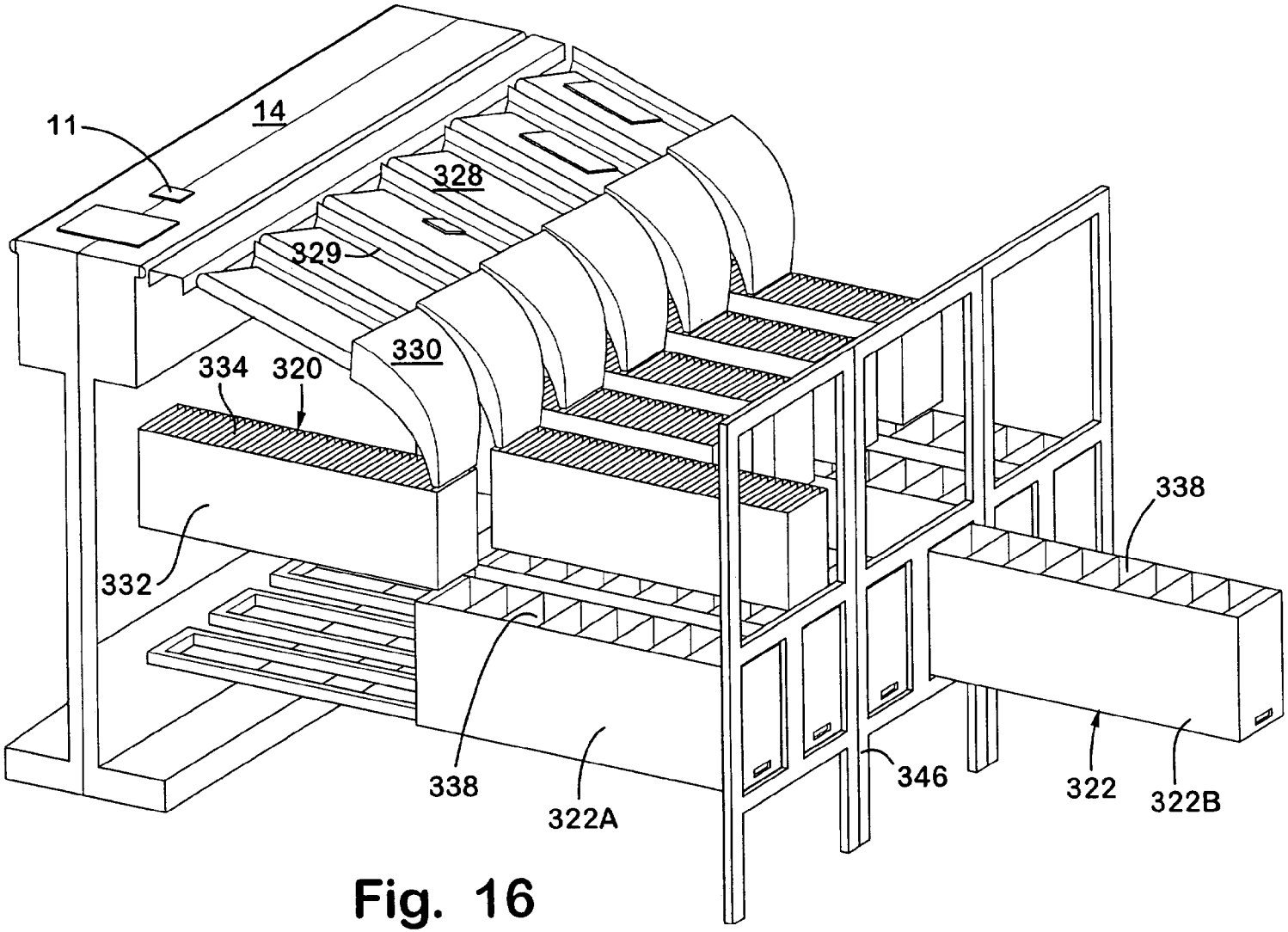
Figure 16A:
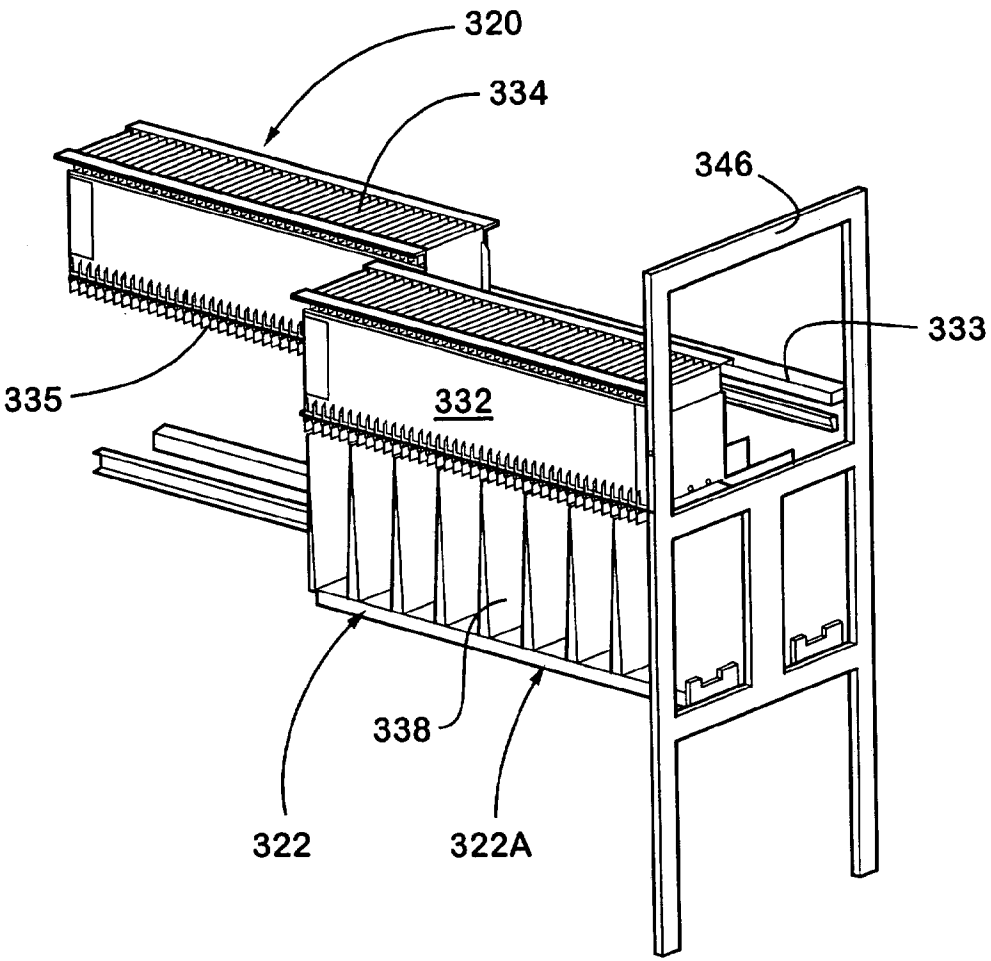
FIG. 16A is a perspective view of a portion of the sorting and sequencing assembly of FIGS. 12–16.
Figure 17:
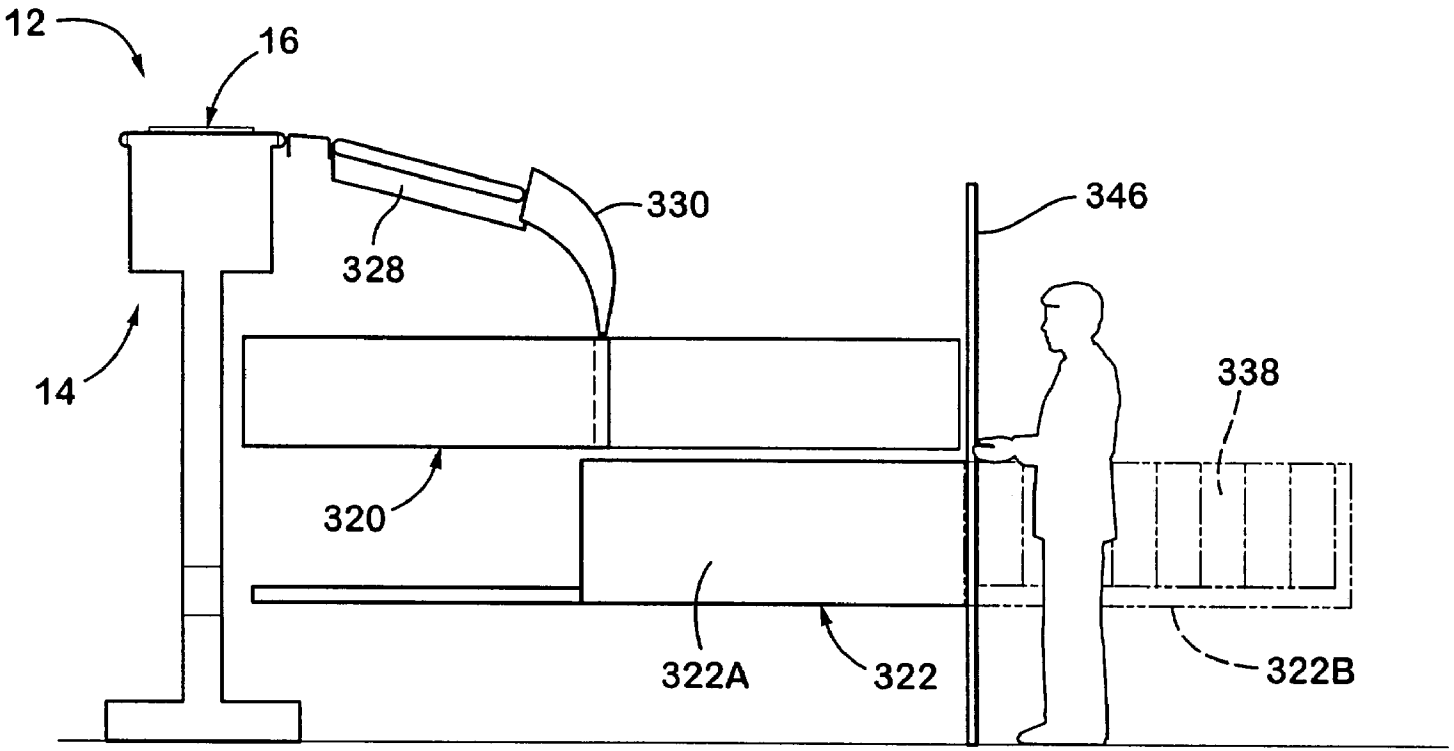
FIG. 17 is an end elevation of the sorting and sequencing assembly of FIGS. 12–16.

Because collecting devices 322 of sortation system 310 are oriented generally horizontally, the collecting devices may be slid horizontally between the loading and unloading positions, such as along tracks or rails 323 (FIGS. 14 and 16A). This is advantageous in applications where a safety wall or fence 346 may be erected around the collating devices and discharge chutes. In such applications, the horizontally oriented collecting devices 322 may be slid, such as in a similar fashion as a drawer, through the wall and into the loading position 322A. After loading of a particular collecting device 322 is complete, the collecting device 322 may then be slid outward from the wall to the unloading position 322B. Accordingly, the operator or unloading station may be positioned outside of the wall 346, such that the collating device 320 may receive articles during a second sort process while the operator is simultaneously unloading articles from the collector that were sorted and sequenced in the collating device during a first sort wave or process.

Therefore, the sortation system or sorting and sequencing system of the present invention may sort articles to a desired sequence after a single sort of the articles. The single sort pass system inducts articles onto crossbelt sorter carriages in a generally random manner and discharges the articles from the carriages onto a particular discharge assembly, where they are discharged into the appropriate bins or cells of the particular collator or cartridge or article receiver, such that the articles may be manually removed or unloaded in the arranged or sequenced manner. The sortation system may include buffer devices or collecting devices or collectors which receive the sorted articles from the respective collators in the sequenced manner and then allow the operator to unload the articles from the collecting devices while the collators concurrently resume receiving articles from the sorter carriages during a second sort wave or process. The sortation system of the present invention thus provides increased throughput of the system, since there is minimal downtime of the sorter carriages and/or collators for the manual unloading or sweeping of the sequenced articles.

Because the present invention is operable to sequence the articles to a desired order or, sequence via a single sort pass, the manual intervention required is minimized, since the only manual interface required is to load the inducts and to unload or sweep the collators or collectors. Therefore, the present invention provides enhanced efficiency for the sequencing processes.

Also, because the present invention provides multiple collators or article receivers, each or some of which may be operable to receive different articles or different sequences of articles, the present invention accommodates different desired articles and/or sequences for different stores. Modifications made to the orders (such as to the desired articles and/or to the sequence of the articles) may be made by modifying the control to allocate the identified articles to different collators or different bins of the same collator, such that no change is made to the manual inducting and unloading processes. This provides for an enhanced changeover or modification of orders, with reduced likelihood of human error due to the modification, since the operators' tasks do not change.

Changes and modifications in the specifically described embodiments can be carried out without departing from the principles of the present invention, which is intended to be limited only by the scope of the appended claims, as interpreted according to the principles of patent law.

The embodiments of the invention in which an exclusive property or privilege is claimed are defined as follows:

1. A single pass sequencing assembly for automatically sorting and sequencing articles to an unloading station in a sequenced manner comprising:

a transport mechanism for transporting articles, said transport mechanism having at least one discharge chute for discharging the articles; and at least one article receiver for selectively receiving articles from said at least one discharge chute of said transport mechanism, said at least one article receiver having a plurality of bins, said at least one article receiver being movable along a longitudinal axis of said at least one article receiver, said at least one article receiver being selectively movable in either direction along said longitudinal axis to selectively align a selected one of said bins with said at least one discharge chute, said at least one article receiver selectively receiving articles in said bins such that the articles are received and sequenced in said at least one article receiver at a delivery point sequence after a single sort pass.

2. The single pass sequencing assembly of claim 1, wherein said at least one article receiver is positioned generally vertically.

3. A single pass sequencing assembly for automatically sorting and sequencing articles to an unloading station in a sequenced manner comprising:

a transport mechanism for transporting articles, said transport mechanism having at least one discharge chute for discharging the articles; and at least one article receiver for selectively receiving articles from said at least one discharge chute of said transport mechanism, said at least one article receiver having multiple bins and being selectively movable to align said bins with said at least one discharge chute, said at least one article receiver selectively receiving articles in said bins such that the articles are received and sequenced in said at least one article receiver at a delivery point sequence after a single sort pass, wherein said at least one article receiver is tilted at an angle with respect to vertical.

4. A single pass sequencing assembly for automatically sorting and sequencing articles to an unloading station in a sequenced manner comprising:

a transport mechanism for transporting articles, said transport mechanism having at least one discharge chute for discharging the articles; and at least one article receiver for selectively receiving articles from said at least one discharge chute of said transport mechanism, said at least one article receiver having multiple bins and being selectively movable to align said bins with said at least one discharge chute, said at least one article receiver selectively receiving articles in said bins such that the articles are received and sequenced in said at least one article receiver at a delivery point sequence after a single sort pass, wherein said at least one article receiver is positioned generally borizontally.

5. A single pass sequencing assembly for automatically sorting and sequencing articles to an unloading station in a sequenced manner comprising:

a transport mechanism for transporting articles, said transport mechanism having at least one discharge chute for discharging the articles;

at least one article receiver for selectively receiving articles from said at least one discharge chute of said transport mechanism, said at least one article receiver having a plurality of bins, said at least one article receiver being movable along a longitudinal axis of said at least one article receiver, said at least one article receiver being selectively movable in opposite directions along said longitudinal axis to selectively align a selected one of said bins with said at least one discharge chute, said at least one article receiver selectively receiving articles in said bins such that the articles arc received and sequenced in said at least one article receiver at a delivery point sequence after a single sort pass; and at least one collecting device for collecting sequenced articles from said at least one article receiver.

6. The single pass sequencing assembly of claim 5, wherein said at least one collecting device comprises a plurality of collector bins which are positionable relative to said bins of said at least one article receiver for receiving articles from said bins of said at least one article receiver.

7. The single pass sequencing assembly of claim 6, wherein each of said plurality of collector bins is adapted to receive articles from at least two of said plurality of bins of said at least one article receiver.

8. The single pass sequencing assembly of claim 7, wherein said at least one article receiver is positioned generally horizontal and said at least one collecting device is positioned generally horizontal and generally beneath said at least one article receiver.

9. The single pass sequencing assembly of claim 8, wherein said at least one collecting device is generally horizontally movable to an unloading position away from said at least one article receiver for unloading of articles within said at least one collecting device.

10. The single pass sequencing assembly of claim 9, wherein said at least one article receiver is operable to selectively receive articles while said at least one collecting device is in said unloading position.

11. The single pass sequencing assembly of claim 5, wherein said at least one article receiver is operable to open at least two of said bins generally at the same time to discharge received articles from said bins to said at least one collecting device.

12. The single pass sequencing assembly of claim 5, wherein said at least one article receiver comprises a plurality of article receivers positioned along a conveying path, said transport mechanism transporting articles along said conveying path and discharging articles to an appropriate one of said plurality of article receivers via a corresponding one of a plurality of discharge chutes.

13. A method of sorting articles to a particular sequence comprising:

transporting articles with a transport mechanism;

inducting articles to at least one article receiver via at least one discharge chute, said at least one article receiver having a plurality of bins for receiving articles therein; and selectively moving said at least one article receiver in a first direction to generally align a first selected bin with said at least one discharge chute and selectively moving said at least one article receiver in a second direction to generally align a second selected bin with said at least one discharge chute for selectively receiving the articles in said bins such that the articles are received and sequenced in said at least one article receiver in a delivery point sequence after a single sort pass.

14. The method of claim 13, wherein transporting articles comprises transporting articles via a plurality of carriages moving along a conveying path and wherein inducting articles to at least one article receiver comprises inducting articles into a plurality of article receivers positioned along said conveying path via a plurality of discharge chutes.

15. The method of claim 13 including discharging sequenced articles from said at least one article receiver into at least one collecting device.

16. The method of claim 15 including selectively receiving articles in said at least one article receiver while simultaneously unloading previously sequenced articles from said at least one collecting device.

17. The method of claim 16 including moving said at lean one collecting device to an unloading position away from said at least one article receiver prior to unloading sequenced articles from said at least one collecting device.

18. The method of claim 15, wherein discharging sequenced articles comprises discharging sequenced articles from at least two of said bins at generally the same time into at least one collecting device.

19. The method of claim 13, wherein selectively moving said at least one article receiver comprises selectively moving said at least one article receiver in opposite directions to generally align said bins wit said at least one discharge chute.

20. A sequencing assembly comprising:

a transport assembly for transporting articles along a transport path, said transport assembly having a plurality of discharge chutes positioned along said transport path; and a plurality of collating devices positioned along said transport path, said transport assembly being operable to receive articles from an induct and to discharge articles to an appropriate one of said collating devices via a respective one of said discharge chutes, each of said collating devices including a plurality of bins for receiving articles discharged from said discharge chute, said collating devices being operable to selectively move said bins to generally align with said discharge chutes, said collating devices being operable to selectively move said bins in a first direction to generally align a first bin with said discharge chute and to selectively move said bins in a second direction to generally align a second bin with said discharge chute, said collating devices selectively receiving articles discharged from said discharge chutes in appropriate bins so that articles are received in said bins of said collating devices in a sequenced manner.

21. The sequencing assembly of claim 20, wherein said collating device is operable to selectively move said bins in opposite directions to generally align said bins with said discharge chute.

22. The sequencing assembly of claim 20, wherein said collating devices are operable to align said appropriate bin with said discharge chute when an article corresponding to said appropriate bin arrives at said discharge chute.

23. The sequencing assembly of claim 20, wherein said transport assembly includes a plurality of carriages movable to transport articles along said transport path, said carriages discharging articles onto a discharge conveyor at said discharge chute at said appropriate one of said collating devices.

24. The sequencing assembly of claim 23, wherein said discharge conveyor is operable to accumulate articles after they are discharged from said carriages and before they are discharged to said bins of said collating device.

25. The sequencing assembly of claim 23, wherein said discharge conveyor comprises at least one conveyor belt which is operable to receive the articles from said carriages and to convey the articles to said discharge chute for discharging the articles into said collating devices.

26. The sequencing assembly of claim 25, wherein said at least one conveyor belt is operable to buffer articles thereon.

27. A sequencing assembly comprising:

a transport assembly for transporting articles along a transport path, said transport assembly having a plurality of discharge chutes positioned along said transport path; and a plurality of collating devices positioned along said transport path, said transport assembly being operable to receive articles from an induct and to discharge articles to an appropriate one of said collating devices via a respective one or said discharge chutes, each of said collating devices including a plurality of bins for receiving articles discharged from said discharge chute, said collating devices being operable to selectively move said bins to generally align with said discharge chutes, said collating devices selectively receiving articles discharged from said discharge chutes in appropriate bins so that articles are received in said bins of said collating devices in a sequenced manner, said transport assembly including a plurality of carriages movable to transport articles along said transport path, said carriages discharging articles onto a discharge conveyor at said discharge chute at said appropriate one of said collating devices, said discharge conveyor comprising at least one conveyor belt which is operable to receive the articles from said carriages and to convey the articles to said discharge chute for discharging the articles into said collating devices, wherein said at least one conveyor belt is tilted toward one side such that articles being conveyed along said at least one conveyor belt are generally aligned along one side of said at least one conveyor belt.

28. A sequencing assembly comprising:

a transport assembly for transporting articles along a transport path, said transport assembly having a plurality of discharge chutes positioned along said transport path;

a plurality of collating devices positioned along said transport path, said transport assembly being operable to receive articles from an induct and to discharge articles to an appropriate one of said collating devices via a respective one of said discharge chutes, each of said collating devices including a plurality of bins for receiving articles discharged from said discharge chute, said collating devices being operable to selectively move said bins to generally align with said discharge chutes, said bins being selectively movable in opposite directions to align a selected one of said bins with said discharge chute, said collating devices selectively receiving articles discharged from said discharge chutes in appropriate bins so that articles are received in said bins of said collating devices in a sequenced manner; and a plurality of collecting devices which are configured to receive sequenced articles from said bins of respective ones of said collating devices after the articles have been selectively received by said collating devices.

29. The sequencing assembly of claim 28, wherein each of said collecting devices comprises a plurality or collector bins for receiving the sequenced articles.

30. The sequencing assembly of claim 29, wherein each of said plurality of collector bins of said collecting devices is adapted to hold articles from at least two of said bins of said collating devices.

31. The sequencing assembly of claim 29, wherein said collating devices are movable to align said bins of said collating devices with said collector bins of said collecting devices, said bins of said collating devices being openable to discharge the sequenced articles from said collating devices into said collecting devices.

32. A sequencing assembly comprising:

a transport assembly for transporting articles along a transport path, said transport assembly having a plurality of discharge chutes positioned along said transport path;

a plurality of collating devices positioned along said transport path, said transport assembly being operable to receive articles from an induct and to discharge articles to an appropriate one of said collating devices via a respective one of said discharge chutes, each of said collating devices including a plurality of bins for receiving articles discharged from said discharge chute, said collating devices being operable to selectively move said bins to generally align with said discharge chutes, said collating devices selectively receiving articles discharged from said discharge chutes in appropriate bins so that articles are received iii said bins of said collating devices in a sequenced manner; and a plurality of collecting devices which are configured to receive sequenced articles from said bins of respective ones of said collating devices after the articles have been selectively received by said collating devices, wherein said collating devices and said collecting devices are oriented generally horizontally with said collecting devices being positioned generally below said collating devices.

33. The sequencing assembly of claim 32, wherein each of said collecting devices is movable between a loading position generally below said respective collating device for loading the sequenced articles to said collecting device to an unloading position away from said collating device.

34. The sequencing assembly of claim 33, wherein each of said collecting devices is configured to be unloaded by an operator when in said unloading position while said respective collating device is simultaneously operable to selectively receive articles from said carriages during a subsequent sort process.

35. A sequencing assembly comprising:

a transport assembly for transporting articles along a transport path said transport assembly having a plurality of discharge chutes positioned along said transport path;

a plurality of collating devices positioned alone said transport path, said transport assembly being operable to receive articles from an induct and to discharge articles to an appropriate one of said collating devices via a respective one of said discharge chutes, each of said collating devices including a plurality of bins for receiving articles discharged from said discharge chute, said collating devices being operable to selectively move said bins to generally align with said discharge chutes, said collating devices selectively receiving articles discharged from said discharge chutes in appropriate bins so that articles are received in said bins of said collating devices in a sequenced manner; and a plurality of collecting devices which are configured to receive sequenced articles from said bins of respective ones of said collating devices after the articles have been selectively received by said collating devices, wherein said collating devices are tilted at an angle with respect to vertical such that the articles are received by said collating devices in a manner whereby gravity functions to move the articles toward a side or corner of the respective bins of said collating device.

36. The sequencing assembly of claim 35, wherein said collecting devices are tilted to generally correspond to the tilt of said collating devices.

37. The sequencing assembly of claim 35, wherein said collecting devices are adjustable to a generally horizontal position after receiving articles from said collating devices to ease the removal of the articles from said collecting devices by an operator.

38. An article sequencing system comprising:

a transport assembly including a conveying path and a plurality of carriages movable along said conveying path, said transport assembly including at least one induct operable to induct articles onto said plurality of carriages;

a plurality of collators positioned along said conveying path, said collators being operable to receive articles front said plurality of carriages, each of said collators including a plurality of bins and being operable to selectively move said bins in either direction along a longitudinal axis of said collator and relative to a discharge of said sorter carriages to generally align said bins with said discharge such that articles are received by said bins of said collators in a sequenced manner; and a plurality of collecting devices configured to receive the sequenced articles from said bins of said collators, said plurality of collators being operable to discharge received and sequenced articles in said bins into a respective one of said plurality of collecting devices, said plurality of collecting devices being movable to an unloading position for unloading of the sequenced articles from said collecting devices.

39. The article sequencing system of claim 38, wherein said plurality of collecting devices includes a plurality of collecting bins, whereby each of said plurality of collecting bins of each of said collecting devices is operable to receive sequenced articles from a plurality of said plurality of bins of each of said collators.

40. The article sequencing system of claim 39, wherein said collecting devices arc movable between a loading position where said collecting devices are generally aligned with respective ones of said collating devices and an unloading position where said collecting bins of said collecting devices are accessible to an operator for unloading of said collecting devices.

41. The article sequencing system of claim 40, wherein said collators are operable to receive articles from said carriages during a second sort wave while said collecting devices are being simultaneously unloaded by at least one operator.

42. The article sequencing system of claim 38 including a discharge assembly operable to receive articles from said carriages and to discharge the articles to said bins of said collators.

43. The article sequencing system of claim 42, wherein said discharge assembly is operable to accumulate articles until an appropriate one of said bins of said collators is aligned with a discharge of said discharge assembly.

44. The article sequencing system of claim 38, wherein said plurality of collators are positioned generally horizontally and said plurality of collecting devices are positioned generally horizontally and generally below said plurality of collators.

45. The article sequencing system of claim 44, wherein each of said collators is operable to discharge the sequenced articles from said bins of said collator simultaneously to a corresponding one of said collecting devices.

46. The article sequencing system of claim 38, wherein said plurality of collators and said plurality of collecting devices are positioned generally vertically.

47. The article sequencing system of claim 46, wherein said plurality of collecting devices are movable to a generally horizontal unloading position for unloading sequenced articles from said collecting devices.

48. The article sequencing system of claim 38, wherein said collators are selectively movable in opposite directions to align said bins of said collators with said discharge.

49. A method of sorting articles to a desired sequence comprising:

providing a transport assembly having a conveying path, at least one induct along said conveying path, and a plurality of carriages movable along said conveying path;

loading articles onto said plurality of carriages;

discharging articles from said plurality of carriages to a discharge chute at a particular one of a plurality of collators positioned along said conveying path, each of said collators having a plurality of collator bins;

selectively moving said collator bins in a first direction to align an appropriate first one of said collator bins wit said discharge chute;

receiving the discharged articles in said appropriate first one of said collator bins;

selectively moving said collator bins in a second direction to align an appropriate second one of said collator bins with said discharge chute;

receiving the discharged articles in said appropriate second one of said collator bins such that the articles are arranged in said collator bins in a sequenced manner; and unloading said collator bins of said plurality of collators to respective ones of a plurality of collecting devices and receiving said sequenced articles in said plurality of collecting devices.

50. The method of claim 49, wherein unloading said collator bins includes aligning said collator bins with corresponding collector bins of said collecting devices and unloading said collator bins to respective ones of said collector bins.

51. The method of claim 49 including moving said collecting devices to an unloading position after receiving sequenced articles in said collecting devices.

52. The method of claim 51 including manually unloading said collector bins while said collator bins simultaneously selectively receive the discharged articles.

53. The method of claim 49 including buffering articles discharged from said plurality of carriages while selectively moving said collator bins to align an appropriate one of said collator bins with said discharge chute.

54. The method of claim 49 including aligning articles along one side of a discharge conveyor between said carriages and said discharge chute.

55. The method of claim 49, wherein selectively moving said collator bins comprises selectively moving said collator bins in opposite directions to align an appropriate one of said collator bins with said discharge chute.

* * * * *

UNITED STATES PATENT AND TRADEMARK OFFICE

CERTIFICATE OF CORRECTION

PATENT NO. : 7,012,211 B2
APPLICATION NO. : 10/430525
DATED : March 14, 2006
INVENTOR(S) : Brinkley et al.

It is certified that error appears in the above-identified patent and that said Letters Patent is hereby corrected as shown below:

Column 7
Line 24, insert “Pat” should be --Pat.--
Line 54, insert --,-- after “application”

Column 12
Line 20, “applications.” should be --applications,--

Column 16
Line 55, “or,” should be --or--

Column 18
Claim 4, Line 4, “borizontally” should be --horizontally--
Claim 5, Line 21, “arc” should be --are--

Column 19
Claim 17, Line 27, “lean” should be --least--
Claim 19, Line 38, “wit” should be --with--

Column 20
Claim 27, Line 31, “one or” should be --one of--

Column 21
Claim 29, Line 12, “plurality or” should be --plurality of--
Claim 32, Line 40, “iii” should be --in--
Claim 35, Line 66, “alone” should be --along--

Column 22
Claim 38, Line 37, “front” should be --from--
Claim 40, Line 60, “arc” should be --are--

UNITED STATES PATENT AND TRADEMARK OFFICE

CERTIFICATE OF CORRECTION

PATENT NO. : 7,012,211 B2
APPLICATION NO. : 10/430525
DATED : March 14, 2006
INVENTOR(S) : Brinkley et al.

It is certified that error appears in the above-identified patent and that said Letters Patent is hereby corrected as shown below:

Column 24
Claim 49, Line 2, "wit" should be --with--

Signed and Sealed this

Twenty-seventh Day of May, 2008

JON W. DUDAS
*Director of the United States Patent and Trademark Office*